US008136515B2

(12) United States Patent
Galinson

(10) Patent No.: US 8,136,515 B2
(45) Date of Patent: Mar. 20, 2012

(54) PAINTBALL LOADER AND PAINTBALL GATLING GUN

(76) Inventor: Richard Galinson, Toluca Lake, CA (US)

( * ) Notice: Subject to any disclaimer, the term of this patent is extended or adjusted under 35 U.S.C. 154(b) by 304 days.

(21) Appl. No.: 12/583,902

(22) Filed: Aug. 27, 2009

(65) Prior Publication Data

US 2011/0083654 A1 Apr. 14, 2011

Related U.S. Application Data

(60) Provisional application No. 61/270,096, filed on Jul. 2, 2009.

(51) Int. Cl.
*F41B 11/00* (2006.01)

(52) U.S. Cl. ..... 124/59; 89/12; 124/71; 124/51.1

(58) Field of Classification Search ..... 89/12; 124/59, 124/63–69, 71, 72, 51.1
See application file for complete search history.

(56) References Cited

U.S. PATENT DOCUMENTS

| | | | | | |
|---|---|---|---|---|---|
| 2,849,921 | A * | 9/1958 | Otto | 89/12 |
| 3,380,341 | A * | 4/1968 | Chiabrandy | 89/12 |
| 3,559,630 | A * | 2/1971 | Frye | 124/2 |
| 3,595,128 | A * | 7/1971 | Hoyt, Jr. | 89/12 |
| 3,611,866 | A * | 10/1971 | Jacolucci et al. | 89/12 |
| 3,648,561 | A * | 3/1972 | Stoner | 89/11 |
| 3,688,637 | A * | 9/1972 | Tan | 89/12 |
| 4,617,750 | A * | 10/1986 | Garehime, Jr. | 42/65 |
| 4,834,058 | A * | 5/1989 | Gegere | 124/29 |
| 4,875,459 | A * | 10/1989 | Van Elderen et al. | 124/49 |
| 5,213,089 | A * | 5/1993 | DeLuca | 124/29 |
| 5,283,970 | A * | 2/1994 | Aigner | 42/57 |
| 2008/0022988 | A1 * | 1/2008 | Rosenblum et al. | 124/27 |

* cited by examiner

*Primary Examiner* — Troy Chambers
(74) *Attorney, Agent, or Firm* — Harris F. Brotman

(57) ABSTRACT

A gatling gun style projectile launcher comprising an assembly of rotating, pressurized-air driven guns. A loader assembly mounted on the gun assembly rotates synchronously through mating of drive gears with the assembly of guns. The loader applies centrifugal force to the paintballs within, urging them into loader tubes positioned in the wall of the loader. Synchronous timing gears align the rotating loader tubes with cognate breech openings in the guns, thereby transferring paintballs into the firing positions from which the paintballs are launched.

20 Claims, 26 Drawing Sheets

Paintball Minigun Electrical Schematic

PAINTBALL LOADER AND PAINTBALL GATLING GUN

This application claims the benefit of U.S. Non-Provisional Patent Application No. 61/270,096, filed Jul. 2, 2009.

BACKGROUND OF THE INVENTION

1. Field of the Invention

The present invention relates to a loader for weapons, and, more particularly, to a loader used in conjunction with gatling guns. More specifically, the present invention relates to a paintball loader that is mountable adjacent to a plurality of paintball gun and which sequentially feeds a supply of stored paintballs to the firing chambers of the paintball guns.

2. Description of the Related Art

In the operation of a paintball gun, the player uses a pneumatically powered gun. A variety of gases are used in the art (for example, CO2, Nitrogen, High Pressure Air). Pneumatically powered gun that shoots paintballs are propelled by short bursts of the pressurized gas. Typically, paintballs are gelatin-covered, spherical capsules having a diameter of approximately 11/16 inch that contain a colored liquid. Upon hitting the target or objective, the paintball ruptures and leaves a colored mark.

The current state of the art in paintball loaders involved single-bolt, non-rotating paintball guns. The first pneumatic projectile launchers used manually actuated reciprocating bolts which have several disadvantages that inherently limit the maximum rate of fire achievable. First, only one projectile is loaded at a time. Second, any interruption in the flow of projectiles, such as binding in the loading hopper, reduces the cycle speed. Finally, the bolt must reverse direction during the loading cycle, further reducing the maximum possible cycle speed.

As the game of paintball has grown in sophistication, semi-automatic paintball guns, guns that sequentially fire paintballs as fast as the trigger can be repeatedly pulled by the user, have become more prevalent. The high firing rate capability of semi-automatic paintball guns has necessitated the use of bulk loader devices in conjunction with such guns. Typically, a bulk loader device includes a housing which is positioned above and slightly to one side of the paintball gun. The housing is adapted to internally store a relatively large quantity of paintballs (for example, 100-200 paintballs) and has an outlet opening through which the stored paintballs can sequentially drop. A feed tube is connected to the bottom outlet opening of the housing and is connected to the paintball gun's hollow firing chamber.

During normal operation of the loader, paintballs drop through the bottom housing outlet opening, through the feed tube, and into the gun's firing chamber, such that the paintballs are gravity fed to the gun during firing. Paintball jams frequently occur within the loader housing during rapid sequential firing of the gun. These jams prevent the normal gravity delivery of paintballs downwardly through the housing outlet opening, with the result that the paintball stack contained in the feed tube can be totally depleted by several shots of the paintball gun.

In the past, clearing of such jams has required that the gun be forcibly shaken to dislodge the individual paintballs causing the jam within the loader housing. The need to dislodge the jammed paintballs is highly undesirable since it interrupts the user's ability to continually fire the gun. Internal agitating motors have been added to disrupt any potential blockages and keep the flow constant.

Other prior art loaders can be positioned below the barrel of the gun while still being able to supply paintballs to the firing chamber at the required rate (U.S. Pat. No. 5,954,052).

The rate of fire (ROF) of paintball guns has limitations. The laws of physics restrict the maximum ROF for single-barrel breech paintball guns. Multiple barrel paintball gun rigs have been made by bolting several paintball guns together in a side-by-side fashion, thus increasing the shooter's ROF. In conventional loaders, each successive ball must be sufficiently accelerated from a static position until the paintball is placed in position to be fired. As the bolt clears the breech in the rearward direction, the ball begins to fall into position inside the breech. Typically, pneumatic bolts can reach their rearmost position, stop and return forward before the ball has time to drop completely into the breech, thereby damaging the fragile ball.

Accordingly, a conventional loader would be unable to feed a rotating gun system at high rates of fire. The breeches of a rotating gun system pass would pass by a static loader outlet at speeds higher than would allow a paintball to be introduced into the breech. The problem is the tendency of paintballs to break due to misalignment of the loader outlet as paintballs are fed into the moving breeches of barrels on a rotating gun assembly. Prior art loader mechanisms do not reliably chamber the paintball as it is "handed" off from the loader into the firing chamber. During this part of the operation, control of the timing is not adequate to assure trouble-free operation.

The result is breakage and consequent jamming due to the fragility of the paintballs as the loader feeds individual paintballs into the breeches of successively positioned barrels. Simply stated, a static, conventional loader cannot be successfully mated to multiple, rotating breeches at high speeds. Thus, there is a continuing need for improved loaders.

SUMMARY OF THE INVENTION

The present invention is a gatling gun style projectile launcher. The gatling gun comprises a rotatable assembly or set of pressurized gas-driven guns mounted in a guide. Mounted on the guide is a loader mounting arm. A rotatable loader assembly is attached to the mounting arm. The loader force-transfers projectiles, e.g. paintballs from the loader into a breech opening formed in each of the guns. The rotatable loader and rotatable set of guns are in geared connection. A hopper is mounted on the loader. The hopper stores and force-feeds paintball into the loader.

An electric motor and motor control circuits control the firing rate of the guns.

In operation, the loader rotates so that each successive projectile synchronously positions with a breach opening of each barrel of the set of guns. The gun subassembly rotates about a longitudinal axis of the rotating gun subassembly.

The rotation of the circular interior configuration of the loader causes paintballs to move by centrifugal force to the surface of the inner wall of the loader. The wall of the loader body has formed there through a plurality of radially oriented loader tubes. Paintballs are centrifugally urged into the loader tube via an inner port. Positioned on the outer wall of the loader body are the outer ports of the loader tubes.

The outer ports of the loader body and the breech openings of the gun subassembly match up 1:1 as the rotation progresses. Each loader outer port passes one ball to its matched (cognate) breech opening. All pairs of outer ports and breech openings repeat this process for every rotation of the gun/loader operation. Synchronous speeds allow for maximum duration of outer port to breech opening alignment.

As the loader body continues to rotate, a continuous supply of paintballs is fed into the central cavity from the hopper bin. Each paintball of a continuous string of paintballs is force-pushed into a firing chamber through a breech opening into the firing chamber of each gun, each firing chamber successively matched in rotation with a respective outer port rotating at a matching rotational speed.

The present invention addresses the problems of the prior art loaders and offers improvements essential to their correction.

The present invention overcomes these problems by providing acceleration and synchronization to prevent paintball breakage.

One object of this invention to provide a means for improving the degree of reliability achieved within the loader and improving the synchronization between the loader and rotating breech/gun assembly.

Another object of this invention is to allow a single loader to achieve a much higher rate of fire than prior art has allowed.

Another object of this invention is to substantially eliminate ball breakage due to timing issues and impact forces.

A still further object of this invention is to reliably align the paintballs as they transfer from loader to gun to achieve unhindered transfer of balls which are not damaged in the transfer process. This is accomplished through the addition of a set of timing gears.

Further objects and advantages of the invention will become apparent as the following description proceeds and the features of novelty which characterize the invention will be pointed out with particularity in the claims annexed to and forming part of the specification.

BRIEF DESCRIPTION OF THE DRAWINGS

The present invention may be readily described by reference to the accompanying drawings in which.

DESCRIPTION OF THE PREFERRED EMBODIMENTS

Figure 1:
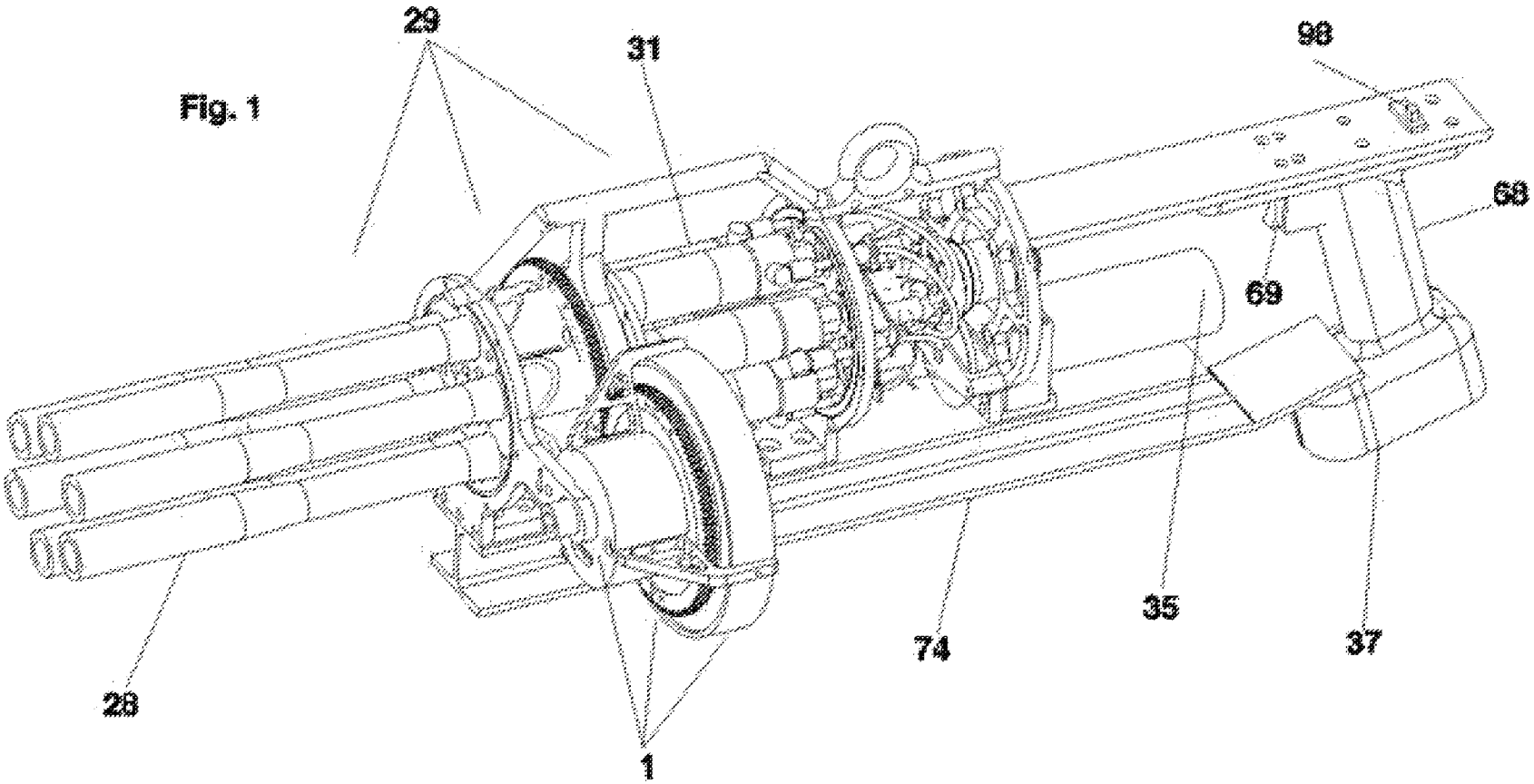
FIG. 1 is a perspective view showing the loader mounted on a paintball gatling gun.

The inventor has found that successful operation of the gatling projectile gun of the present invention is achieved by a combination of structures that rotates the body of a loader subassembly 6 such that each successive projectile 24 is synchronously positioned with the entrance to a breach opening 26 of a barrel 28 of a set of barrels 30 which comprises a gun subassembly, 29 in rotation about a longitudinal axis 28*a* of the rotating gun subassembly.

A preferred embodiment of the present invention is a gatling gun which launches paintballs. Suitable for launching by the gatling gun are projectiles which include, but are not limited to, pepper balls, waterfalls, plastic balls, rubber balls, metal balls or any spherical object that fits inside the diameter of barrels of guns incorporated into the gatling gun. A preferred gun is a standard paintball gun barrel which launches projectiles sufficient in diameter to block the short burst of pressurized gas used to propel it from the gun. The present invention comprises a paintball loader subassembly 1 (FIGS. 2, 4, 5, 10, 11, 13, 14, 23) mounted next to the firing chambers i.e., breeches 25 of a paintball gun 94 to continuously supply paintballs 24 to the paintball gun. In the present specification, the terms loader and loader assembly are used interchangeably. The paintball loader 1 of the invention responds instantaneously to a demand for paintballs, such that no interruption occurs in the firing rate of the paintball gun, once primed, until empty. The paintball loader of the invention includes a generally hollow body 6 which serves as a hopper 10 or bin for storing a supply of paintballs.

The paintball loader 1 further includes a drive gear 50 that is connected to the loader body 6 such that the drive gear operates to force transfer instead of e.g. gravity feed, individual paintballs 24 out of the loader 1 and into a breech opening 26 through a small gap 27 formed by the cognate, matched configuration of the loader tube's outer 17 port and a breech opening 26 of the paintball gun 94.

The body 6 of the loader 1 includes a central cavity 11 which is a circular member having a series of individual loader tubes 15 spaced around the loader body wall's inner circumference 13. The body of the loader is freely rotatable within ball bearings 76 contained in the housing 2 of the paintball loader.

As shown in FIGS. 4, 5, 13, 23, the rotation of the circular interior configuration of the loader causes paintballs 24 to move by centrifugal force to the surface of the inner wall 13 of the loader where the balls eventually are driven centrifugally into loader tubes 15.

Figure 8:
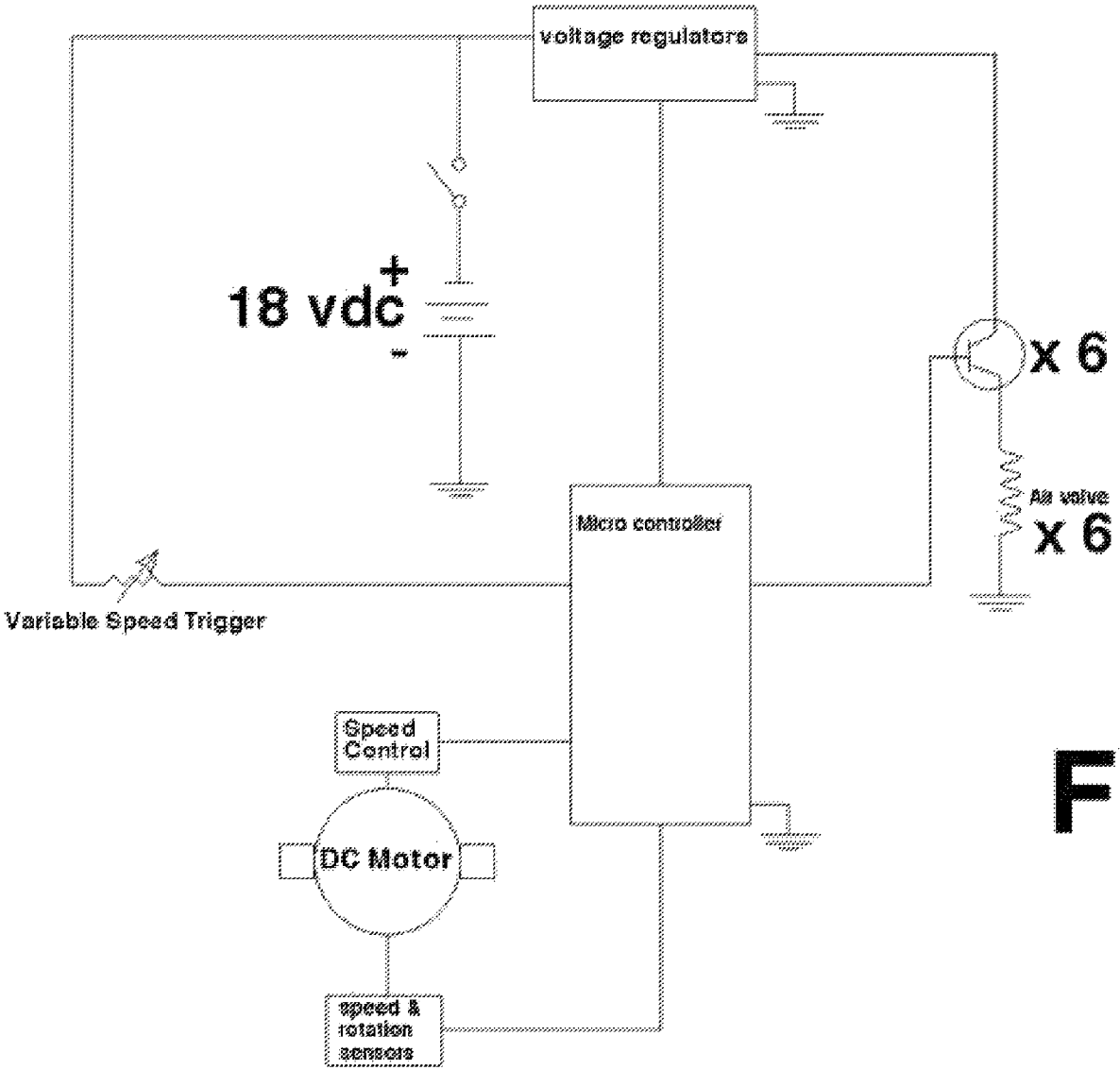
FIG. 8 is a circuit diagram of the motor control circuit of the present invention.

The driving force of the paintball loader is controlled by a motor control circuit FIG. 8 that operates the motor 35 based on certain parameters associated with the motor. The motor includes a drive shaft 39 which is coupled to the rotatable gun assembly through a gear train 48. As the drive shaft of the motor rotates, the loader body 6 rotates as well. As the rotation continues, the rotatingly driven gun assembly 29, which is in linkage with the loader body, causes the loader body 6 to rotate and forces the individual paintballs 24 into the loader tubes 15.

A deflector 34 (FIG. 4) is positioned across the small gap 27 between a loader tube's outer port 17 and a breech inlet opening 26, and extends into the loader body. Centrifugal force causes the paintballs to exit the loader tubes in a tangential direction in proportion to the rotational speed of the loader. This force, in conjunction with the deflector 34 causes the paintballs 24 to be diverted from the loader tubes 15 into the breech openings 26 in the shortest possible distance. As the gun assembly 29 continues to rotate, paintballs 24 positioned in the loader tubes 15 pass between the outer ports 17 of the loader 15 and the breech openings 26 of the paintball gun 94.

Accordingly, paintball transfer is achieved through a relatively large, unobstructed entrance or window in which the ball is transferred from the loader into a firing position 33. The rotational speed of the loader at the point of transfer is equivalent to the rotational speed of the rotating breech/gun assembly. Thus, encountering no difference in rotational speed between the outer port 17 of the loader tube 15 and its cognate breech opening 26, the paintball is not subjected to unbalanced forces which are likely to break the paintball during the transfer from loader to gun. Further, the paintball is not subjected to any potentially damaging collisions with structures moving at different speeds. Brief contact between the transferring paintball and the static deflector occurs at an extremely oblique angle thus imparting negligible forces upon said paintball. The paintball travels at the same axial speed as the mechanisms responsible for the transfer. The structures and operation of the present invention avoid the problem of paintballs breaking in a loading mechanism. The present invention provides a mechanism which force inputs each paintball into a breech opening and into firing position of the paintball gun. The loader and gun comprise, respectively, a loader subassembly 3 and a gun subassembly 29. The loader and gun subassemblies achieve and maintain accurate and precise alignment between a loader tube 15 and its cognate breech opening 26 for loading that is essential for assuring reliable, fault-free operation.

In the present invention, the loader is mounted in close juxtaposition with the gun assembly, thereby minimizing the "feed" distance. A deflector 34 is positioned to direct the balls into their respective breaches in the shortest distance. Each paintball is always in contact with some part of the loader or gun. Once the paintball has been transferred to the firing position, upper breech retainer 34*a* acts to retain the paintball in said position until the bolt 52 has driven forward and fired the paintball. This upper breech retainer 34*a* covers the exposed port of the breeches as they pass the loading point for approximately $1/6^{th}$ of the rotation. The purpose of this upper retainer is to keep the paintball from exiting the breech due to centrifugal forces until fired pneumatically. In the event that a paintball is unsuccessfully launched from one of the guns, the unspent paintball will be automatically ejected from the breech opening upon passing the end of the breech retainer. Where the breech retainer does not cover the breech openings during their rotation, centrifugal forces urge any unspent paintballs from said opening. This design feature allows for automatic unloading of the guns to avoid double-loading and further breakages.

Operation of the Invention

The operator activates the motor 35, which rotates the gun subassembly 29 via a gear train 48. The gun subassembly is equipped with an external timing gear 49 that then drives an equivalent timing gear 50 fixedly attached to the body 6 of the loader 1. This linkage between the body of the loader and the gun subassembly forces the loader's rotational speed to match the gun's rotational speed.

The loader rotates a mass of paintballs 51 inside the loader's internal cavity 11 at a rotational speed that exactly matches the speed of the rotating gun assembly. Centrifugal force directs the balls outward toward the surface of the inner wall 13 of the loader body's central cavity 11.

The wall 12 of the loader body has formed there through a plurality of radially oriented channels, termed loader tubes 15. The entrance from the loader cavity into a loader tube is termed the inner port 16. Positioned on the outer wall 14 of the loader body are the outer ports 17 of the loader tube 15. The balls enter the inner ports 16 due to centrifugal forces and are forced toward the outer ports 17.

The balls are retained from exiting the outer ports by a static retainer wall 21 encompassing all but an open section 22 of retainer wall of the loader body. This open section 22 of the retainer wall 21 faces the gun subassembly 29. As the loader body rotates, a ball which had become positioned in a loader tube remains subject to centrifugal force. When that loader tube rotates into the 'unretained' section 22, centrifugal force urges the ball through the outer port, projecting the ball across a small gap 27 between the loader and the breech openings of the gun assembly. As it exits the outer port, a paintball contacts a deflector ramp 34 which urges the ball toward the breech opening.

The outer ports 17 of the loader body 6 and the breech openings 26 of the gun subassembly match up 1:1 as the rotation progresses. Each loader outer port 17 passes one ball to its matched (cognate) breech opening. All six pairs of outer ports and breech openings repeat this process for every rotation of the gun/loader operation. Synchronous speeds allow for maximum duration of outer port to breech opening alignment. Any differential in these speeds would only serve to reduce the time the two cognate ports share proximity during ball transfer, thereby increasing the likelihood of ball breakage during transfer.

Referring to FIGS. 4, 5, 13, 14, 23, each loader tube houses one paintball at its outermost position 18, along the inner surface of the loader retainer's wall. A second paintball is stacked behind the first due to centrifugal force and is exerting a small force upon the first paintball. Both paintballs, due to centrifugal force, would exit the loader's port when the outer retainer wall ends. The controlled loading of only a single paintball is desired. The solution to this problem is the introduction of a small inner retainer wall 79. This static retainer wall is positioned such that it passes thru the air space between two adjacent paintballs without touching either of them. This retainer wall is introduced to the space between these paintballs just prior to the outer retainer wall ending with respect to the rotation of the loader. As the loader tube and paintballs pass the end of the outer retainer wall, both balls begin to move radially outward. The outermost paintball continues to exit while the inner paintball begins to make contact with this small inner retainer wall. This inner retainer wall impedes the radial progress of the second paintball. As this loader tube passes the first paintball completely to its cognate breech opening, the second paintball is still impeded by the inner retainer wall. As the loader continues to rotate, the loader tube now encounters the beginning of the outer retainer wall again. This outer retainer wall effectively seals the outer port of the loader tube. At the same point in the rotation, the small inner retainer wall is no longer needed to impede the second paintball's radial movement and it terminates. The second paintball then begins its radial movement to become the outermost paintball 18 in the loader tube. Another paintball from the central cavity of the loader now enters the inner port into the vacant inner ball position, and the cycle starts again.

The gatling gun 94 of the invention incorporates a set 30*a* of guns that fire sequentially as the guns are rotated by a drive motor. A class of guns for use in the present invention is semi-automatic firing types.

Accordingly, feeding of paintballs to the firing mechanisms of the gun barrels is achieved by the loader mechanism which takes individual paintballs stored in a hopper 10 and force feeds them through breech openings into the firing positions of rotating set of guns 30*a*.

Figure 2:
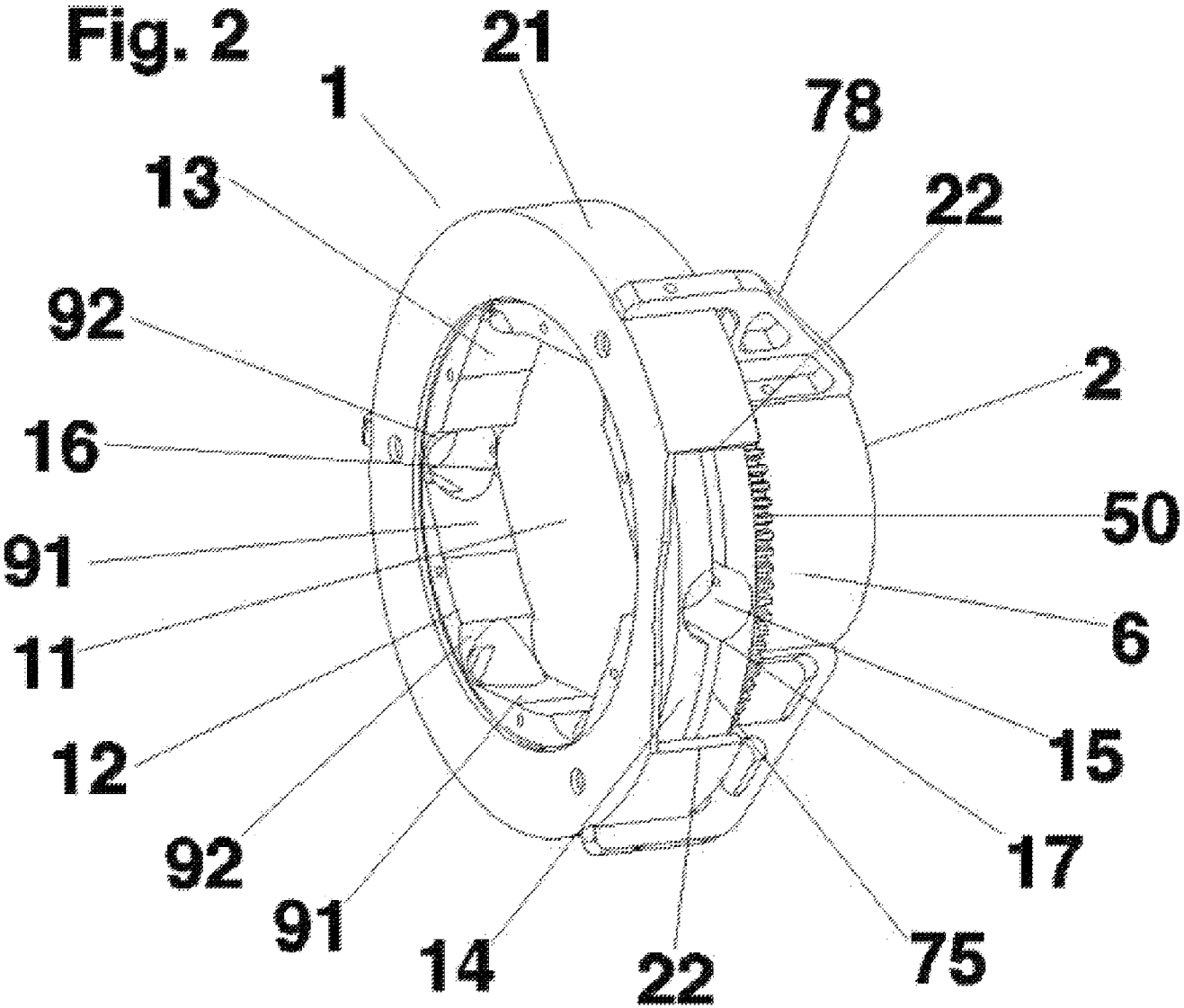
FIG. 2 is a perspective view of the loader.
Figure 3:
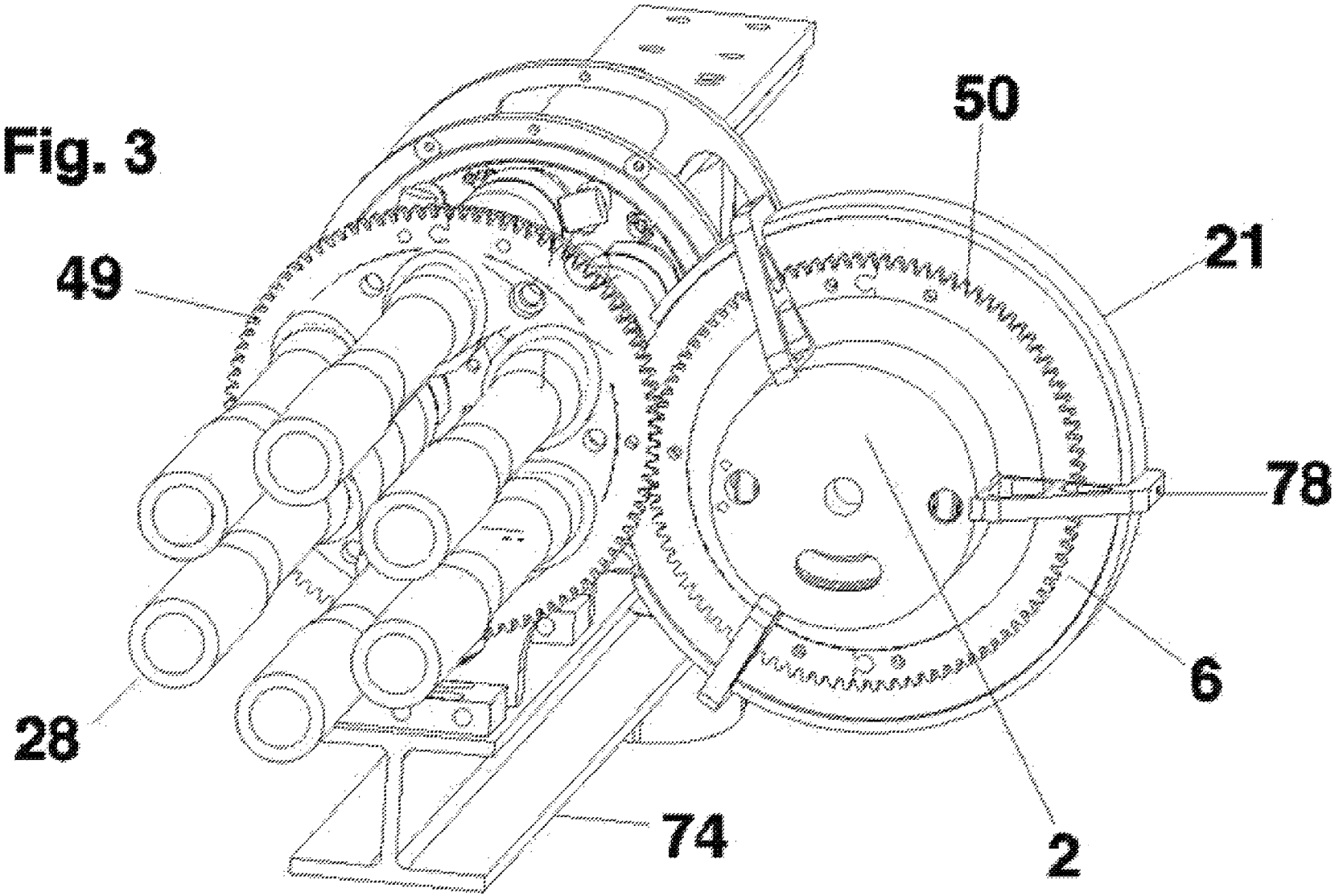
FIG. 3 is front perspective view of loader drive mechanism.

Referring more particularly to the drawings, FIG. 2 discloses the loader of the invention through which a paintball passes from a holding stage, to a transfer stage, and a delivery stage. The holding stage is the hopper and subsequently the central cavity. The transfer stage is made up of the six loader tubes. The delivery stage is the 'virtual passageway' comprising the loader tube exit port, the deflector and the breech opening in the cognate paintball gun.

Figure 4:
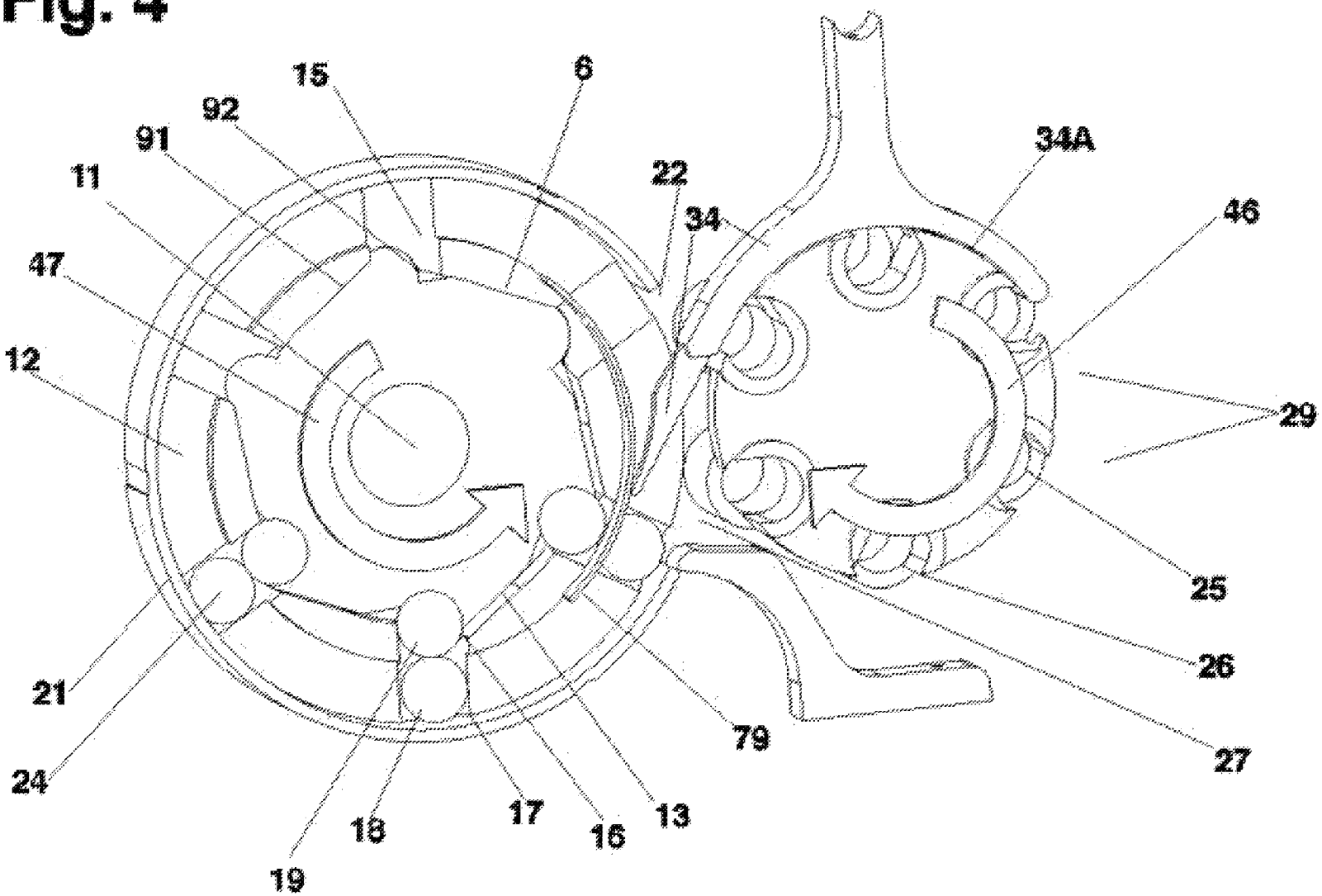
FIG. 4 is a rear perspective view of an isolated rotatable assembly juxtaposed to the loader and illustrating the deflector.

In the operation of the gatling gun 94, a drive motor 35 causes a gun subassembly 29 to rotate as indicated by arrow 47 (FIG. 4). Responding to the rotation of the gun subassembly 29, the gating gun 94 fires each gun of its gun subassembly 29 in rapid succession. Simultaneously, vis a vis the external timing drive gear 49 and the equivalent timing drive gear 50, the loader rotates. The rotation accelerates paintballs positioned in loading tubes to a speed that matches the rotational speed of the gun subassembly enabling the loader to synchronously transfer one by one and without obstruction a procession of paintballs from the loader to the breech openings of the gun subassembly.

Figure 22:
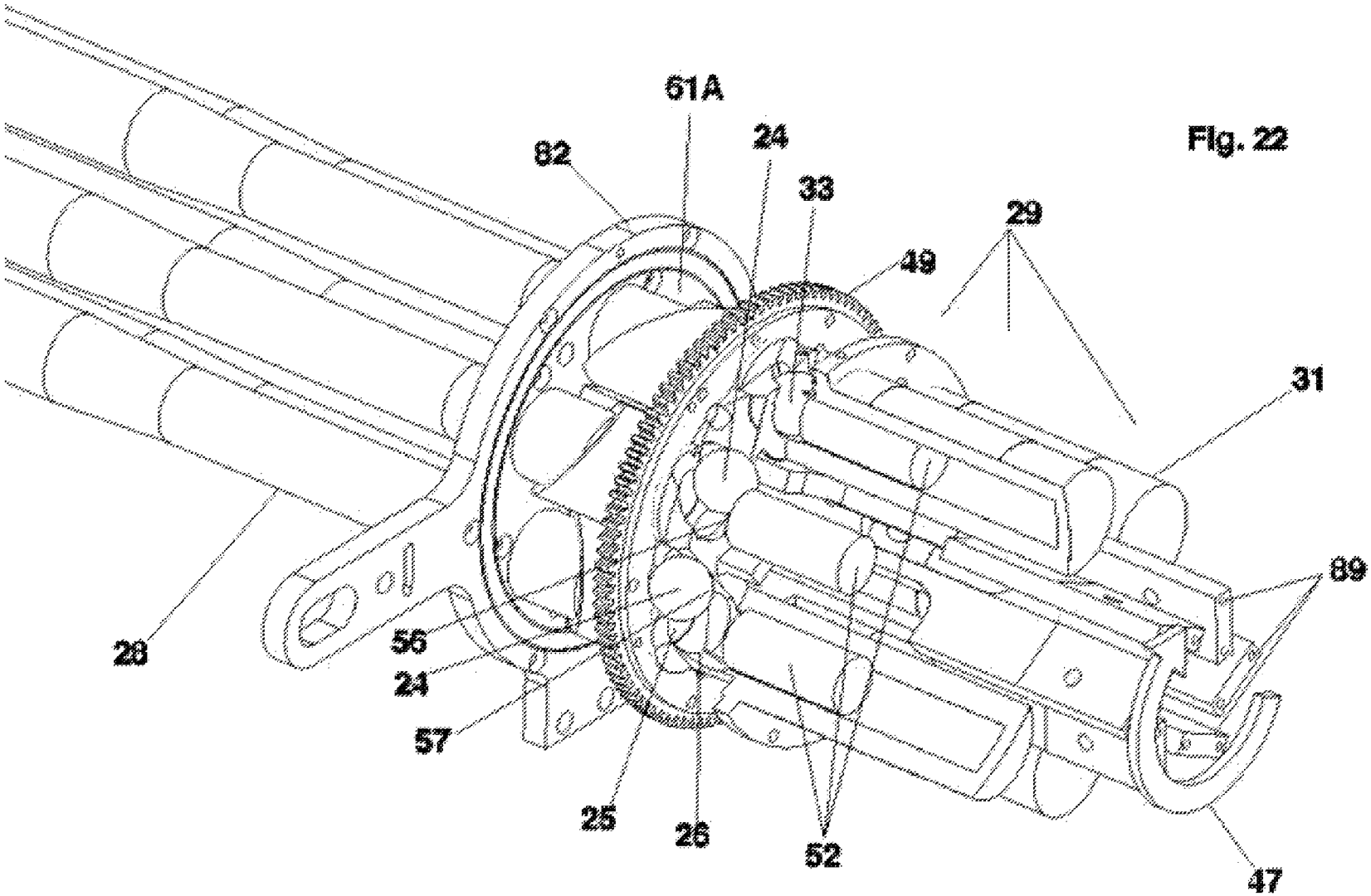
FIG. 22 is a side rear perspective cut-away view of a partially disassembled gatling gun showing the push bolts of the firing mechanisms.

A ball launching mechanism of the gatling gun as shown in FIG. 22 comprises a set of push bolts 52, one push bolt for each gun. In the illustrated embodiment, a ring of guns, the gun subassembly comprises six barrels of six guns and, thus, includes six push bolts. A push bolt 52 comprises a cylindrical body. Bolts move longitudinally inside longitudinal gun bodies which are uniformly distributed about the axis of rotation while fixedly attached to the rotating front 61*a* and rear 61 discs, each bolt being aligned with corresponding barrel.

Figure 10:
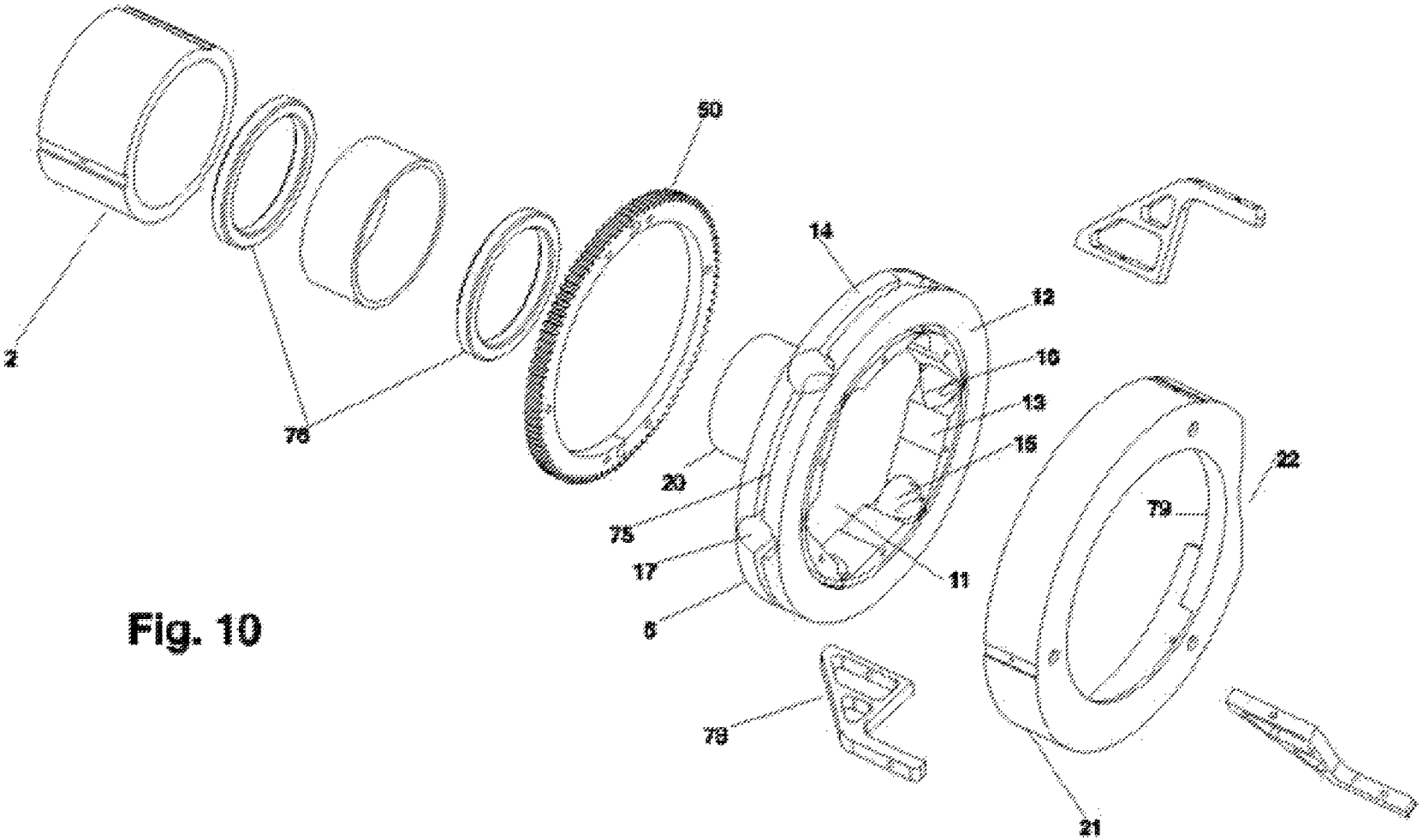
FIG. 10 is an exploded view of the loader.

As shown in FIG. 10, the rotatable assembly of the loader comprises a housing subassembly and a body subassembly.

In the illustrated embodiment, each loader tube is cylindrically shaped. The loader tubes project radially outward from the loader body's axis of rotation. In this way, centrifugal force of a rotating loader achieves cooperation between paintballs and loader tubes, as paintballs are urged to pass into and through loader tubes so as to exit the loader tube synchronously juxtaposed a small gap and into the cognate breech opening.

In a further embodiment, the loader tubes project radially outward from the central cavity of the loader body. The inner wall of the central cavity is not circular in form. Rather, it has faceted aspects to it that allow paintballs to 'roll' along a flat, ramp-like surface into the opening of each loader tube. Where the paintball first encounters a loader tube's inner port is referred to as the "front surface", there is a "rear surface" that constitutes the last, or secondary edge of the loader tube's opening. This "rear surface" of the loader tubes projects radially inward approximately the length of one paintball to form an obstruction that aids in urging the paintballs into the tubes. This feature has the effect of 'scooping' the paintballs that are traveling around the inner wall of the central cavity. Further, it deflects the paintballs into the openings of the loader tubes. The half-round protrusion of the loader tube into the central cavity has an arcuate geometry that aids in urging the paintballs into the proper positions to be loaded.

Figure 11:
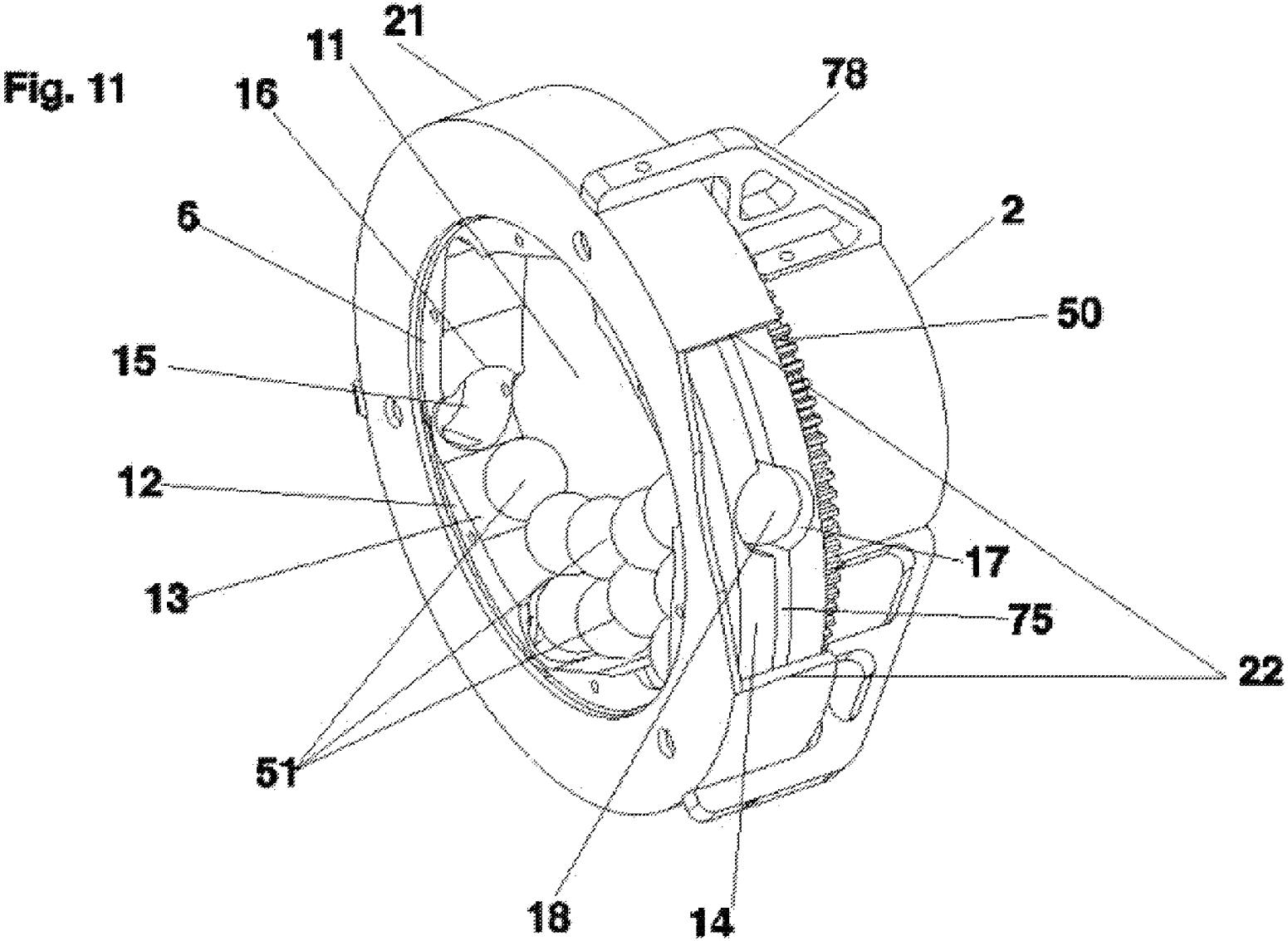
FIG. 11 is a side rear perspective view of a loader in isolation.
Figure 12:
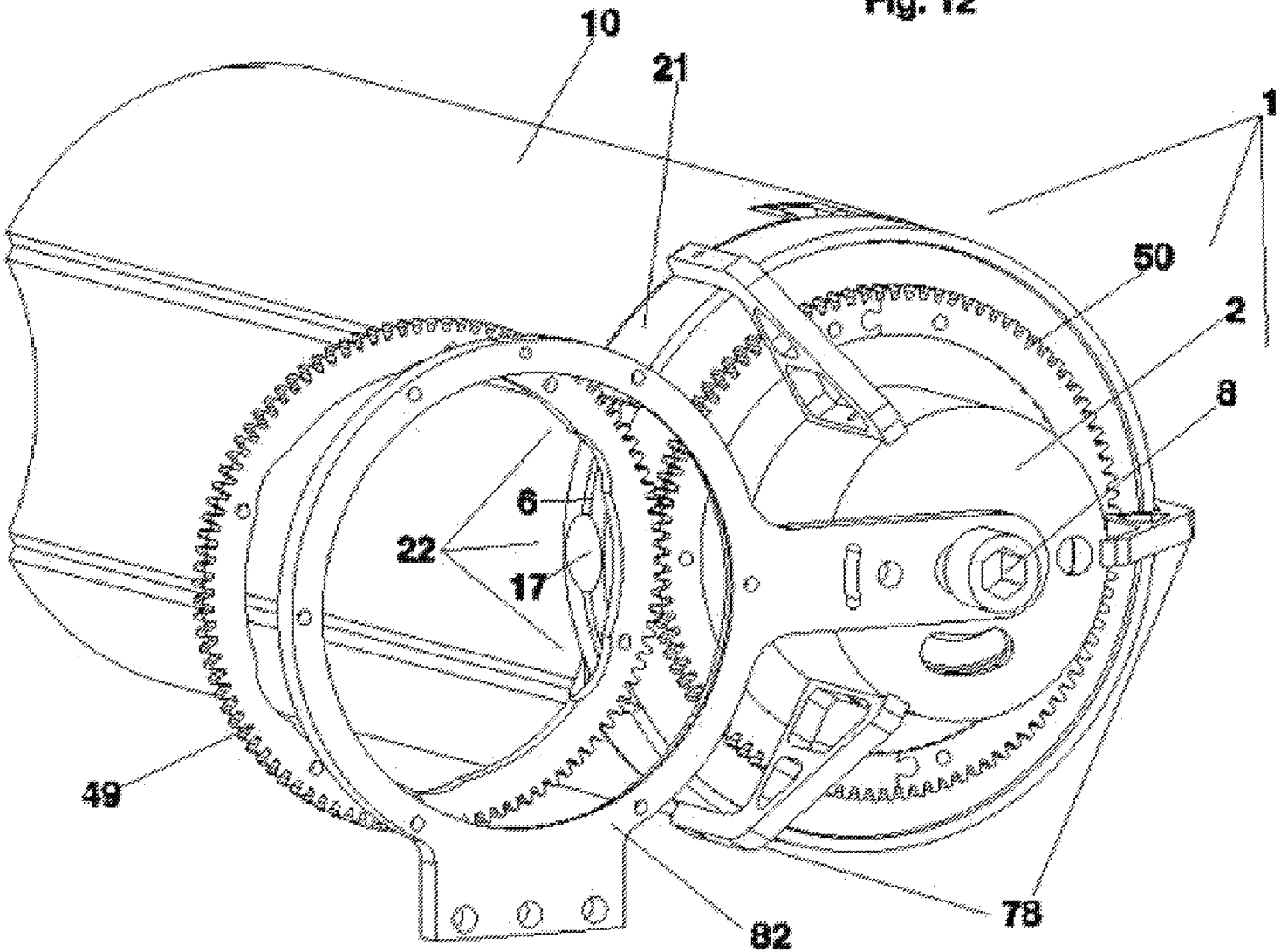
FIG. 12 is a view of the equivalent timing gear and external timing gear.
Figure 13:
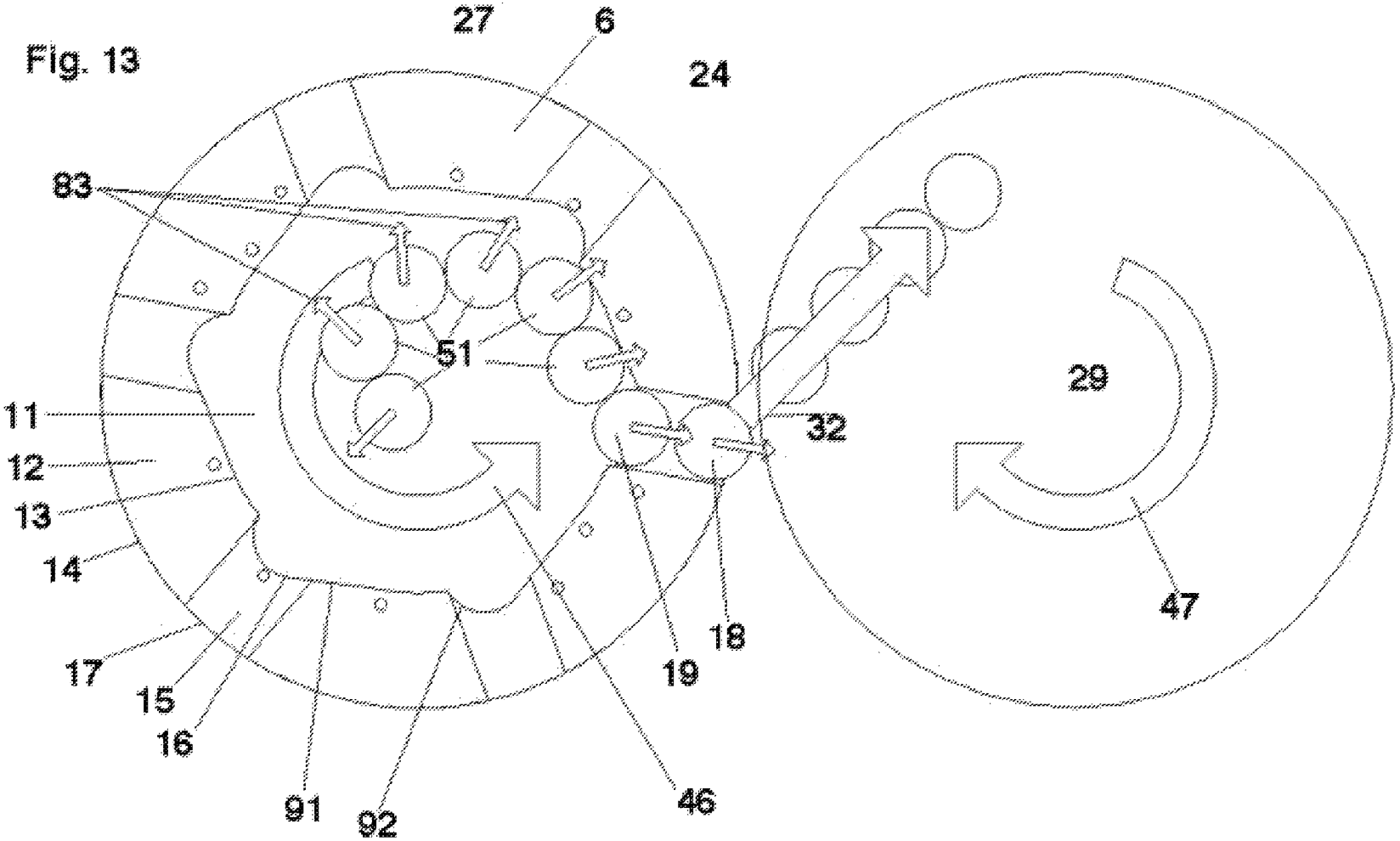
FIG. 13 illustrates the rotational directions of the loader and gun assembly, the centrifugally forced movement of paintballs within the loader, and transfer of paintballs from the loader subassembly into the gun subassembly.

FIG. 11 is a perspective view of the assembled paintball loader. The loader of the present invention preferably has a cylindrical shape, which rotates about an axis that is parallel to the rotational axis of the gun subassembly. Preferably, the hopper of the loader is mounted parallel in relation to the barrels of the gatling gun. Preferably, the axis of rotation is parallel with the axes of the breech and barrel.

FIG. 4 shows a paintball positioned in a loader tube 15 and other paintballs positioned on the inner wall 13 between loader tubes 15. In operation, the paintball exits the outer port 17 of a loader tube 15 when rotation of the loader body positions the outer port in the open section 22 of the retainer wall, unobstructing the loader tube's outer port, thereby connecting the outer port with the space of the breech opening.

Figure 24:
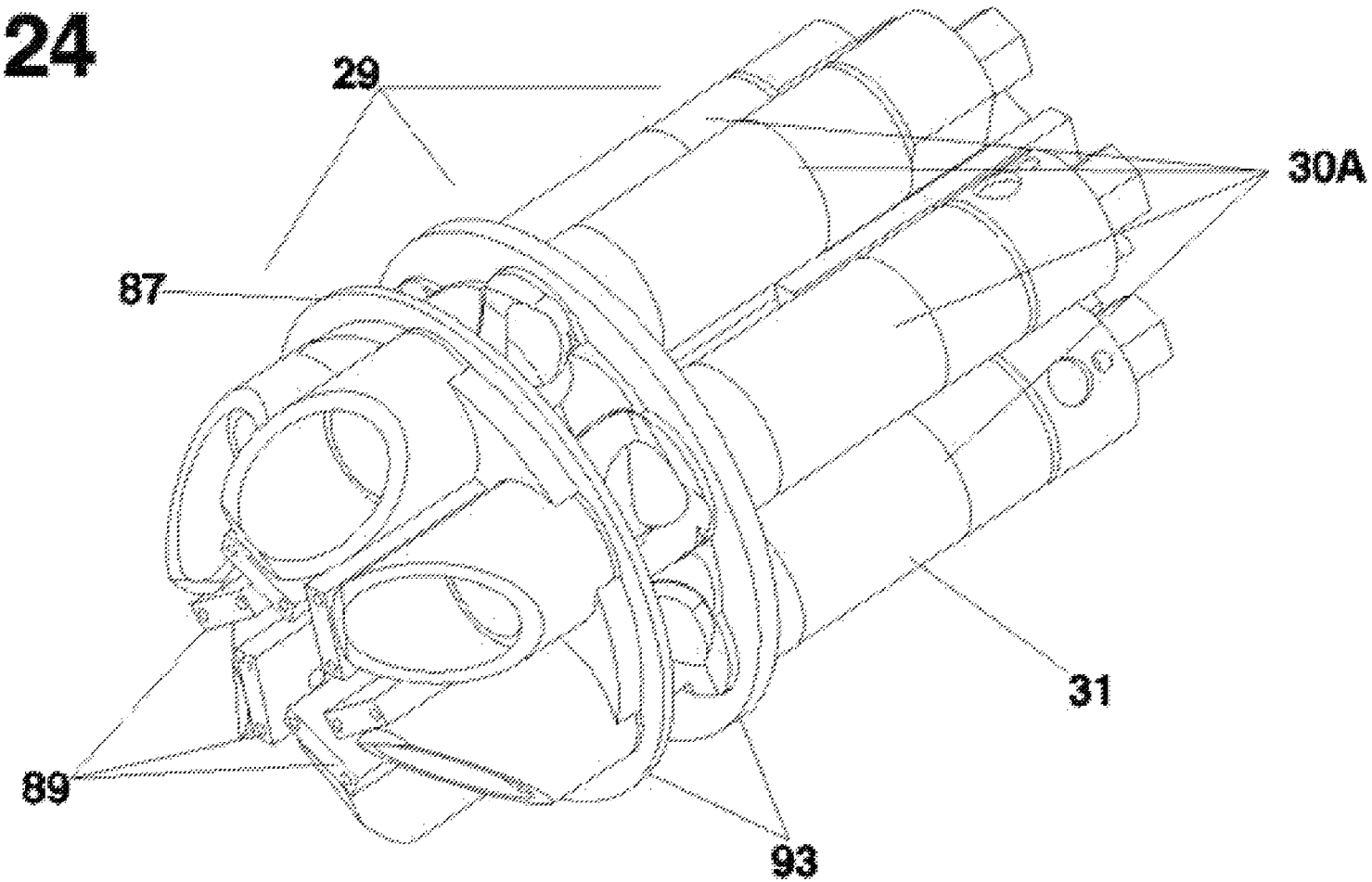
FIG. 24 is a side front perspective view of a partially disassembled gun subassembly showing the breech guide.

During ball transfer from the loader to the gun assembly it is preferred that the paintballs be urged into the breech openings. To facilitate this, a breech guide 87 is used to restrain the balls from diverting from the transfer path. The breech guide is cylindrical in shape and at least 1 inch long. See FIG. 24. Further, there is a radial channel approximately ¾" wide and extending inwardly ½" deep from the breech guide's outer diameter. This channel is approximately centered on the overall width of the guide. Penetrating thru this cylindrical shape are the six gun bodies as well as the gun-mounting brackets. These guns are positioned radially symmetric about the axis of rotation of the gun assembly. The breech openings of each gun are positioned such that they are exposed within the channel of the breech guide. As the paintballs transfer from the loader to the gun assembly, they encounter the underside of the deflector 34, which urges them out of the loader tubes and toward the gun assembly in a radial direction.

The loader body is encased for a majority of its' radial surface by the loader retainer's wall. The relatively small, exposed section of the loader body, where the ball transfer occurs, sits within the channel of the breech guide. As the paintballs leave the confines of the loader tubes they, again, are confined by the walls of the breech guide. The combination of the breech guide's walls and the surface of the deflector forcibly direct the paintball into the breech opening. The deflector's linear underside surface used to direct the paintballs begins to curve at the point of contact with the bottom of the breech guide's channel. The section of the deflector, called the "upper breech retainer" continues around a portion of the circumference of the bottom of the guide's channel. The loaded paintballs located in the firing positions within the breech openings are thus contained by the "virtual breech cover" provided by the underside surface of upper the breech retainer. Centrifugal forces acting upon the paintballs in the rotating gun assembly are negated by the presence of said retainer. The paintballs are confined within the breech opening until fired.

As the loader body rotates, a majority of the paintballs in the loader are located in the central cavity 11 while a number of the paintballs pass centrifugally urged into loading tubes 15. The loader body 6 is rotated by the drive motor, via the timing gears. 49, 50

Figure 25:
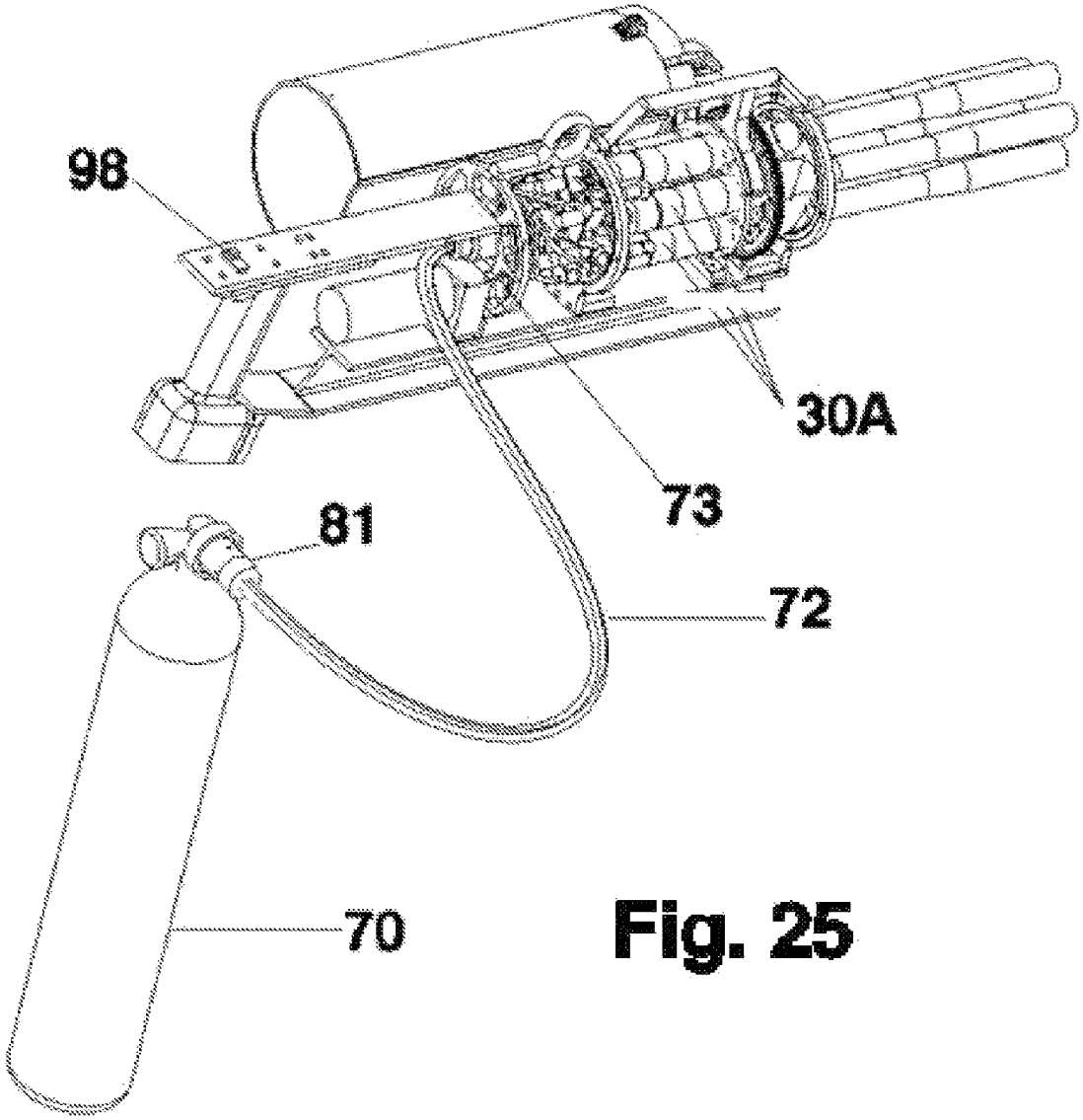
FIG. 25 is a side rear perspective view of the gating gun in hosed connection with a canister of pressurized gas.

The paintball gun is connected to a supply of pressurized gas contained within a canister (FIG. 25). The pressurized gas is supplied to the paintball gun by a supply hose extending between a pressurized regulator fitting 81 and the rear portion of the paintball gun, the rotary union 88. Although the canister is shown in phantom as directly connected to the fitting of the paintball gun, it should be understood that the canister could be located remotely from the paintball gun and connected to the fitting through a flexible hose (not shown). A rotary union is a device to be placed inline with an air supply. It allows continuous, low-friction, rotation of the air supply conduits relative to each other. In the preferred embodiment, the rotary union utilizes ball bearings and seals to allow the gun assembly to freely rotate relative to the static air hose that supplies the compressed gas used to propel the paintballs.

Figure 21:
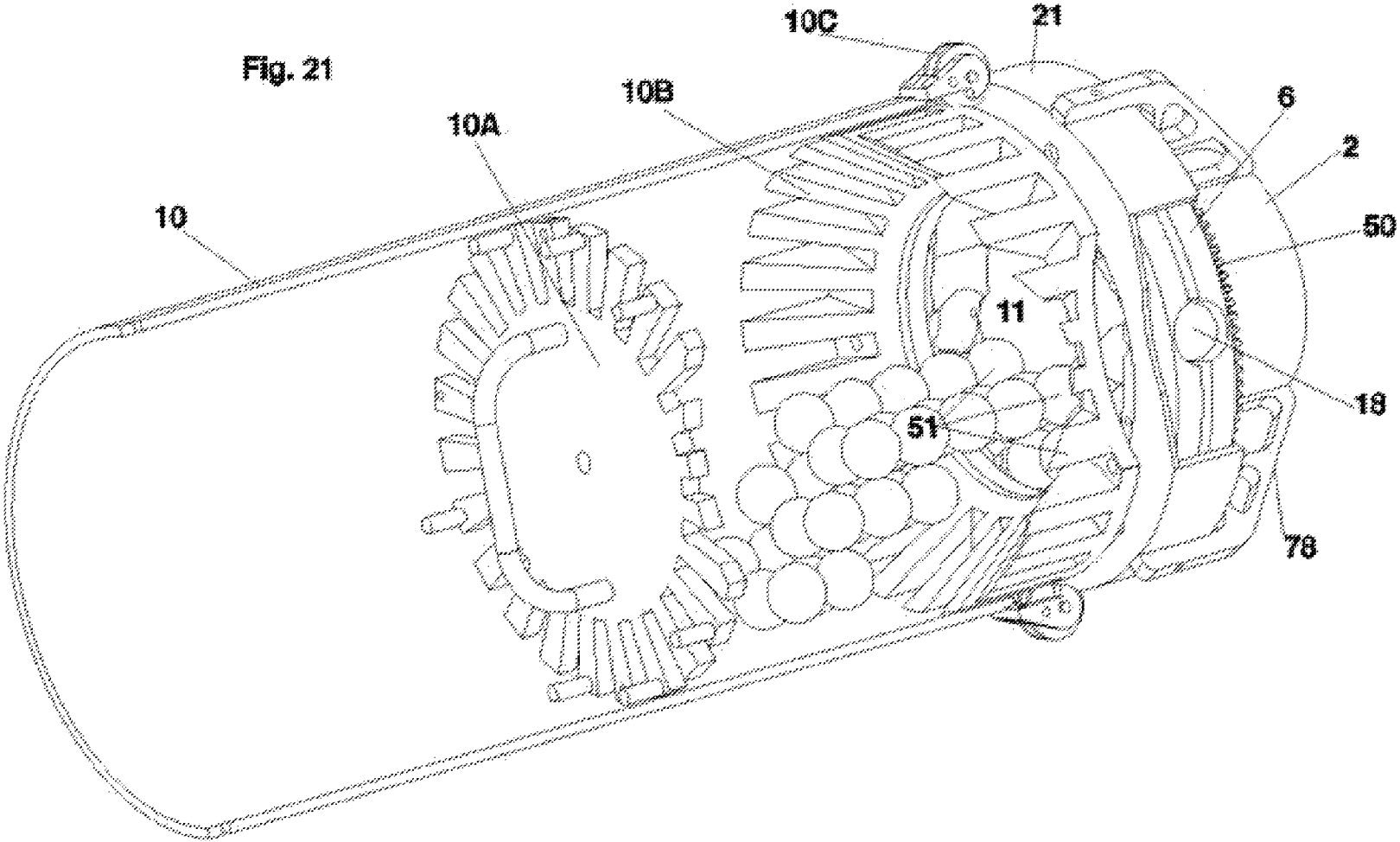
FIG. 21 is a cut-away view of a hopper mounted on the loader subassembly.

In general, the paintball loader includes a generally hollow hopper 10, mounted in juxtaposition to the multibarrel gun subassembly. (FIG. 21) The hopper functions to store a supply of paintballs 24. In the preferred embodiment of the invention, the hopper is a container having a size large enough to accommodate the guns high rate of firing. As seen in FIG. 21, the loader requires that a constant supply of paintballs be introduced into the central cavity of the loader. One embodiment utilizes a spring-loaded lid on a mostly cylindrical hopper to force-feed the supply of paintballs into said cavity. In this embodiment, the diameter of the hopper can be substantially larger than the opening of the cavity and, thus, requires a circular ramp-like structure encircling the entrance to the opening to aid in loading the entire supply into said cavity. The lid and the circular ramp have small radial channels that work in conjunction with each other to allow the lid to travel effectively to the base of the hopper, thus, urging the last of the supply into the loader. The lid is spring-loaded via small cables passing thru the interior of the hopper, around idler pulleys and terminating in a block and tackle attached to extension springs located on the exterior of the hopper.

The path along which the paintball is transferred extends from the outer port of a loader tube 15 to an entry opening formed in the breech of the paintball barrel. The breech opening provides access to the firing chamber of the paintball gun, such that paintballs from the paintball loader transfer on a path formed by the alignment of the loader outer port with the firing chamber. Once in the firing chamber, a paintball is sequentially fired from the paintball gun by short pressure bursts from the pressurized gas source, the bursts created by either sequential pulls or continuous depression of the trigger.

The paintball loader generally includes the hopper, drive gear, mounting brackets and a retainer wall 21. The loader is operatively mounted on the front bearing ring 82 by conventional means, such as a threaded connector 8. In the preferred embodiment of the invention, the hopper is a component that includes a hollow storage bin and an end cap.

Centrifugal force generated by the rotating loader body onto the paintballs moves the paintballs out of the loader and into the gatling gun. The paintball loader of the present invention does not rely on gravity to feed the paintballs to the firing chambers of the guns.

Figure 14:
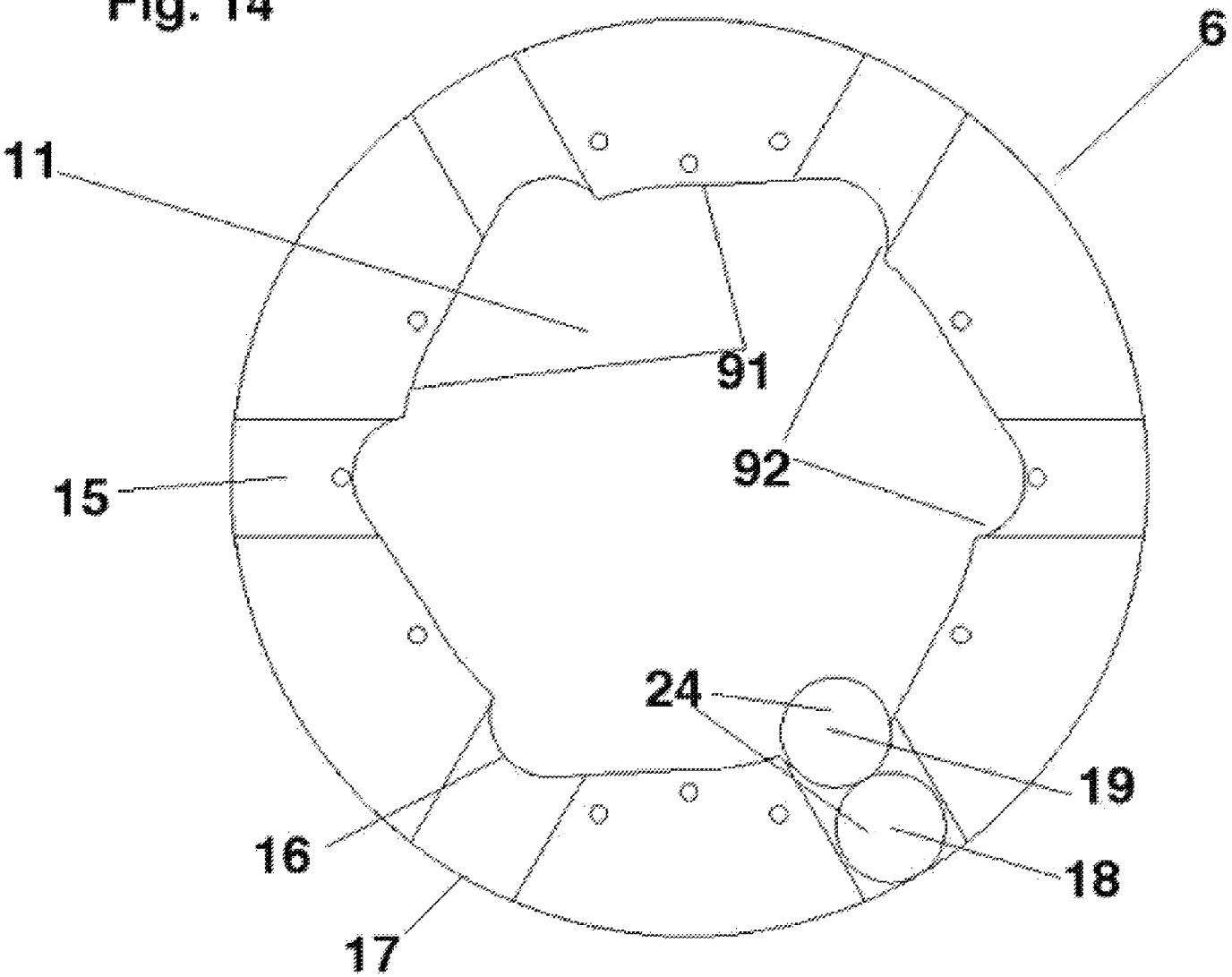
FIG. 14 is a sectional view of the loader.

A loader tube has a diameter approximately equal to the diameter of a paintball and has a length approximately equal to the diameter of at least one paintball, as can be seen in FIGS. 4 and 14.

Figure 15:
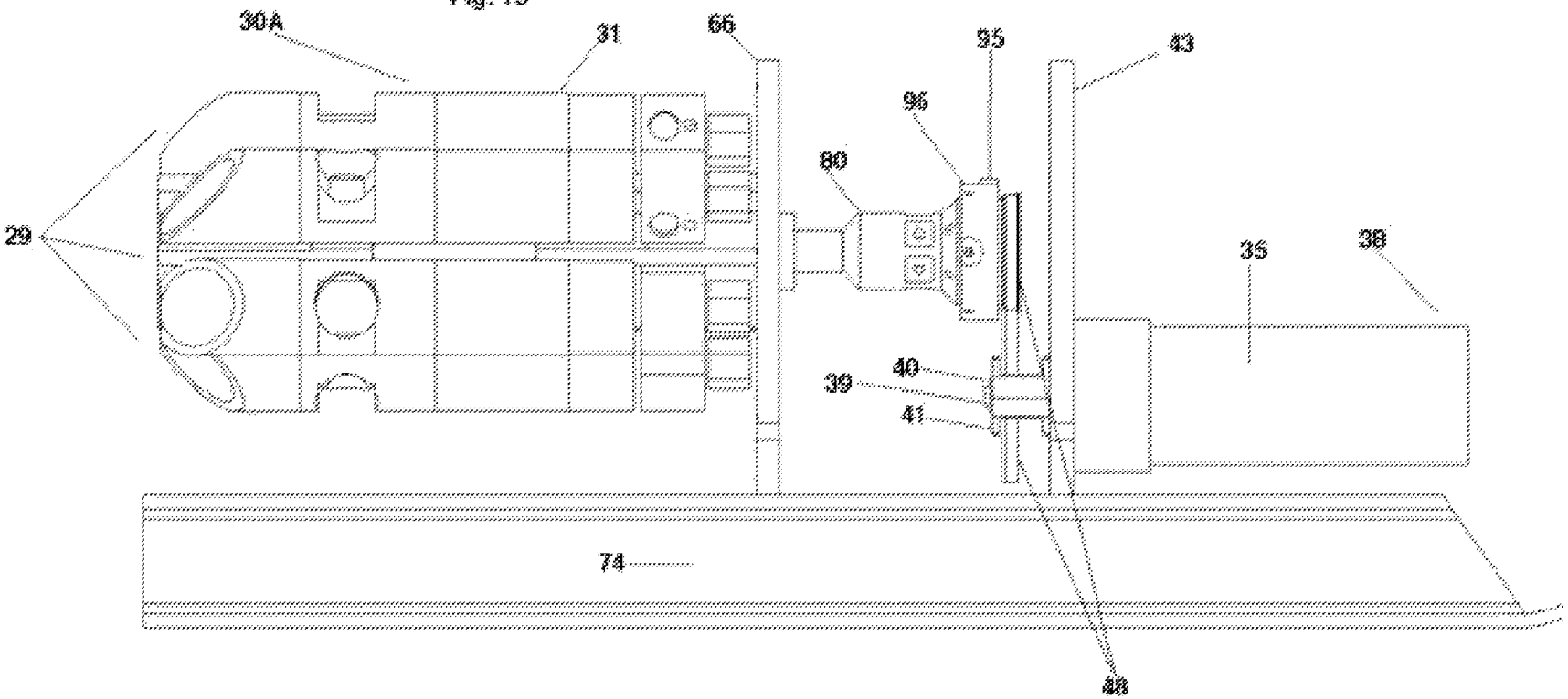
FIG. 15 is a side view of a partially disassembled paintball gun mounted on a frame.
Figure 16:
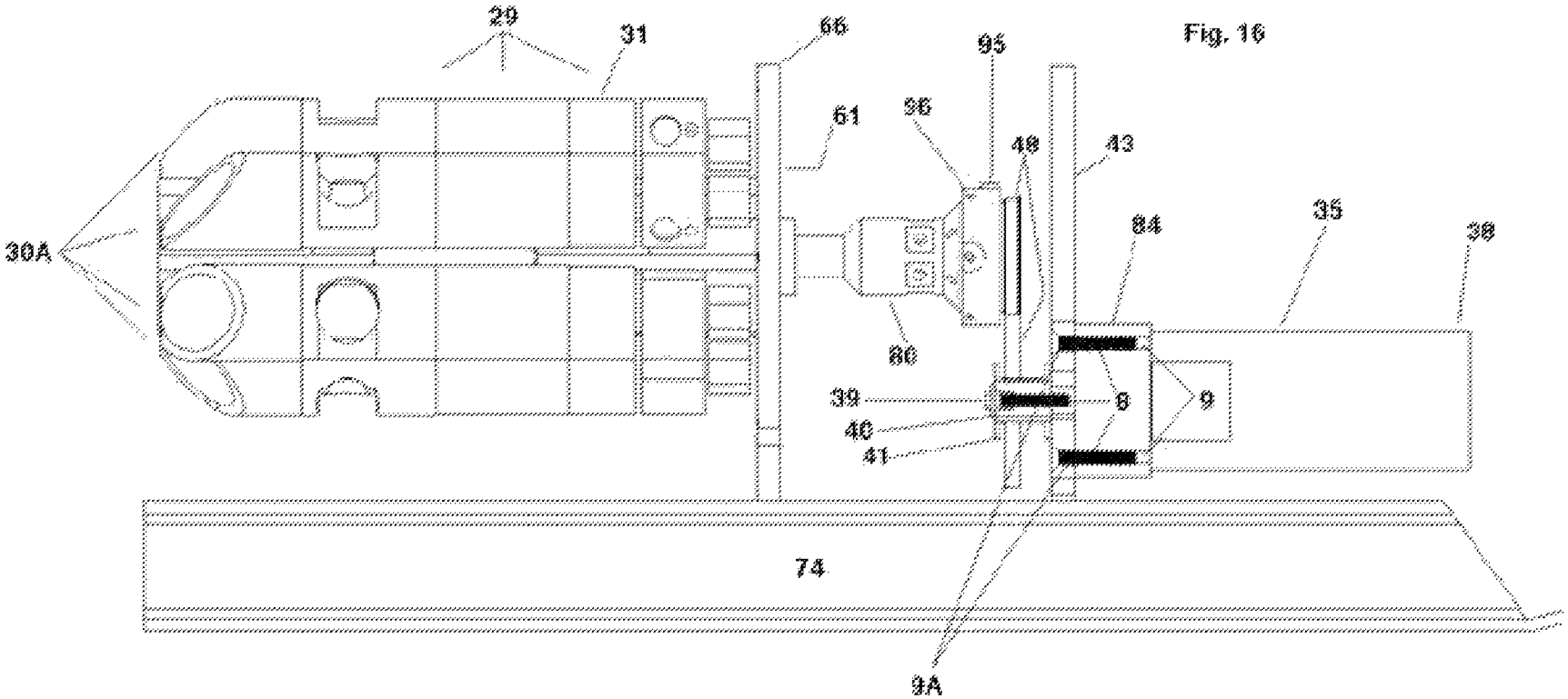
FIG. 16 is a side view of a partially disassembled paintball gun showing the bolt-mediated attachment of the drive system to the gun frame.

Referring again to FIG. 15, the motor 35 includes a drive shaft 39 that extends through a bearing 40 in a bracket 41 and a corresponding clearance hole 42 in the center of the support plate 43. The motor 35 is mounted to the rear of the support plate and is encased by a protective cover 38. As can be seen in FIG. 16, the entire drive system is secured to the gun frame 74 by a plurality of threaded connectors 8 which pass through attachment holes 9*a* in the support plate 43 and are received in attachment holes 9 in motor gear head 84.

Figure 17:
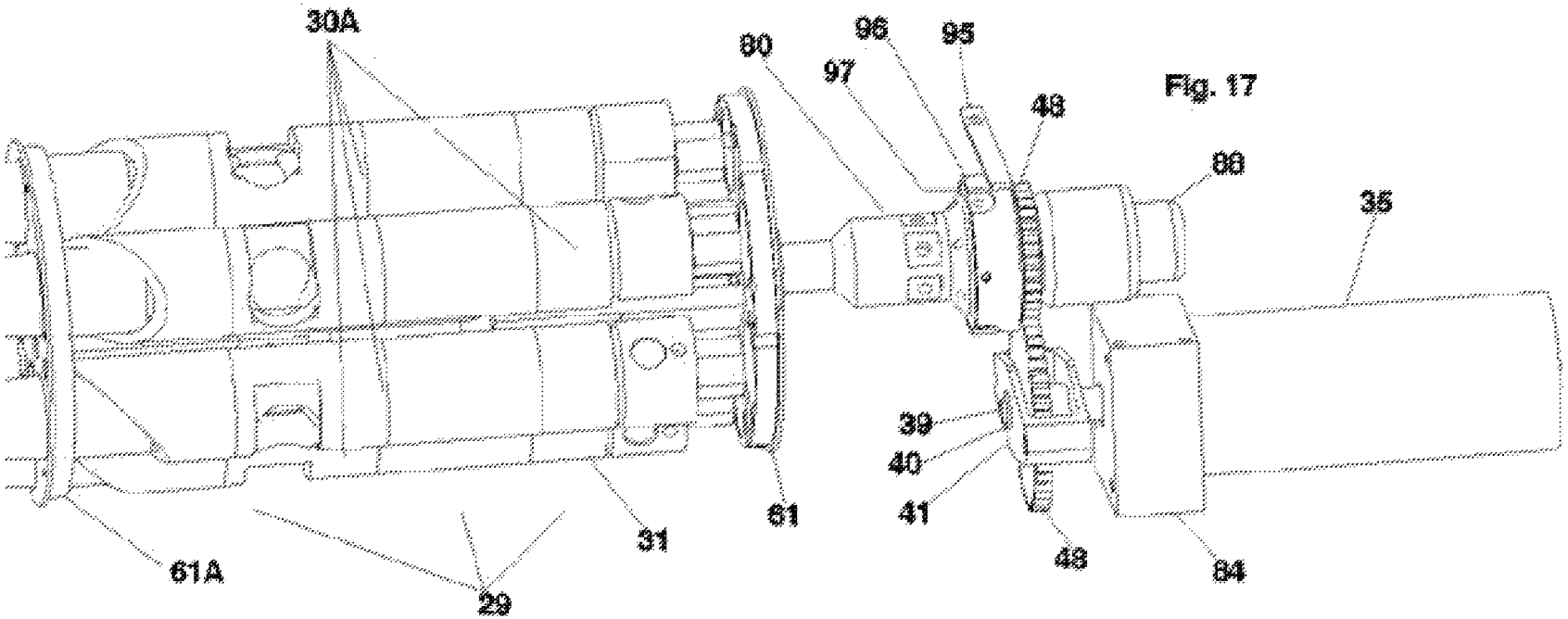
FIG. 17 is a partially disassembled view of the gatling gun showing the position of the manifold, gearing and slip-ring assembly.

Referring now to FIG. 17, the gun assembly 29 coupled to the drive shaft of the motor by a gear train. In a preferred embodiment of the invention, the gear train consists of a set of gears such that a minimum of about 500 RPM is provided on the output shaft. This translates to approximately 50 shots per second or 3000 per minute.

FIG. 17 shows that the power required by the circuit board is supplied via the slip-ring 96 and its contact 95. The slip ring 96 is a metallic ring mounted to a circular insulator 97. This assembly is further mounted to the manifold 80 in such a way as to isolate the positive voltage passing thru the contact 95 and slip-ring 96 from the ground-leg of the supply voltage. The Ground-leg of the supply voltage passes thru all other metallic elements of the paintgun.

During operation of the drive system, the motor rotates the drive shaft, which in turn rotates the gun assembly. The gun assembly exerts a rotational force on the loader body through the timing gears, causing the loader to rotate within the loader housing.

Figure 18:
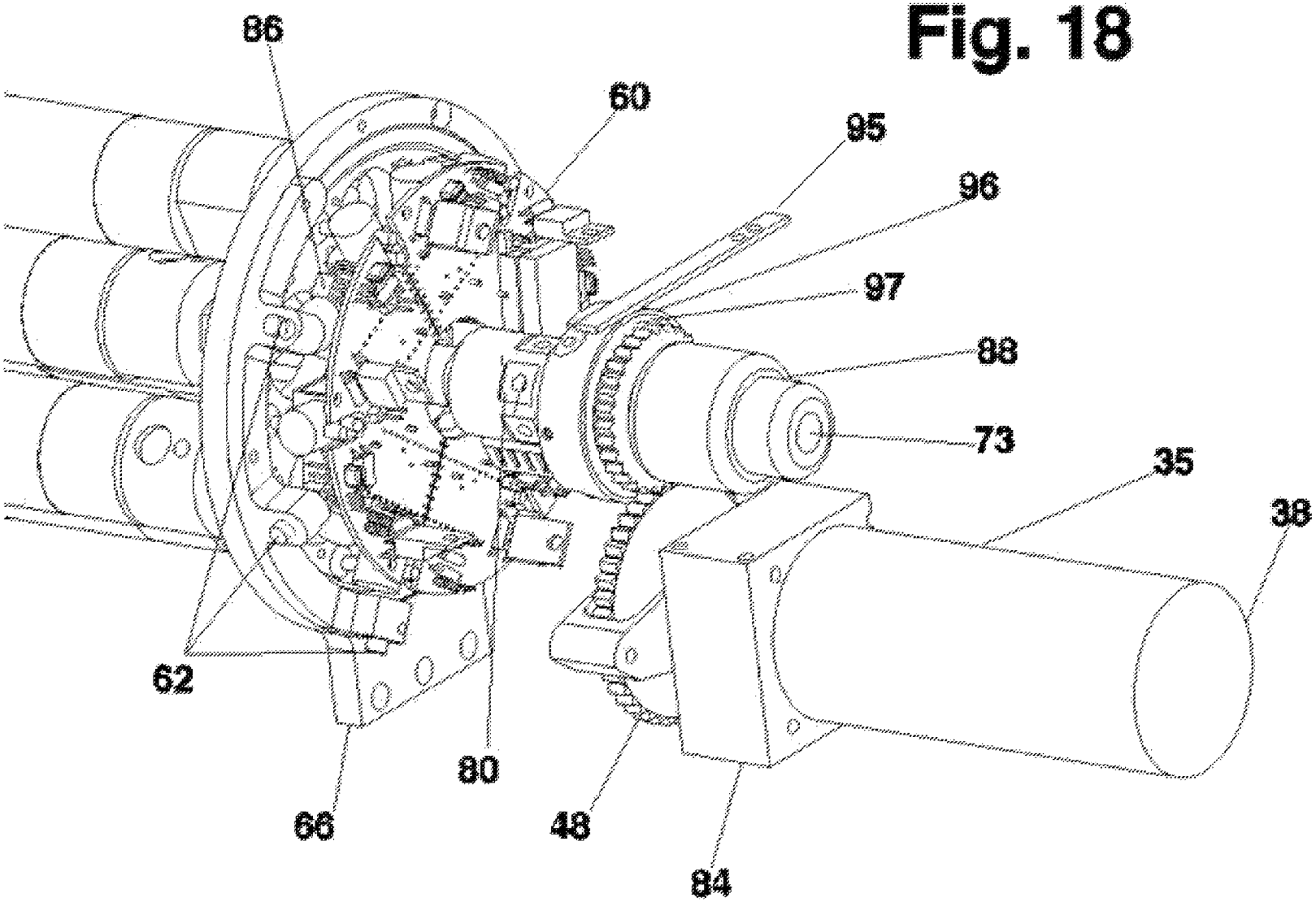
FIG. 18 is a side rear perspective view of a partially disassembled gatling gun which shows the mounting of the electronics, manifold, gear train, motor and air supply connection port.
Figure 19:
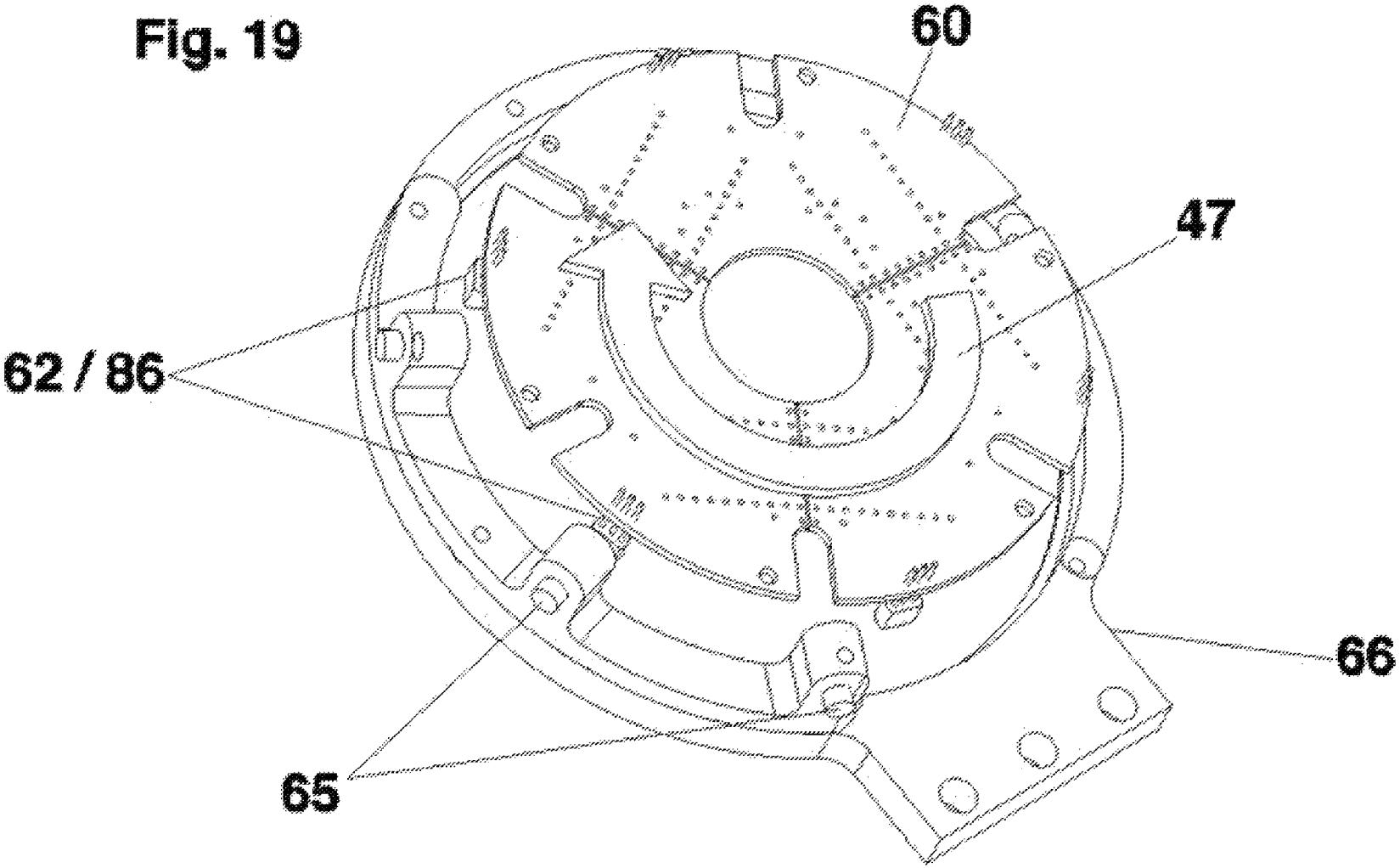
FIG. 19 is a view of an isolated view of the circuit board mounted on the rear disc relative to the rear bearing ring and the magnet(s).

As shown in FIG. 18, the drive system further includes a circuit board 60 and a rotational indicator 62 (FIG. 19). The circuit board includes various electronic components that function to control the operation of the motor, as will be discussed in greater detail below with reference to FIGS. 8 and 9. The circuit board is fixed to the rear disc and is mounted behind the guns and encompassing the pneumatic manifold 80 that supplies the gas from a single, main supply. The manifold 80 has several functions. It is simply a 1 to 6 dividing station for the gases used, it is the mechanical mount for the second gear on the main drive gear train, it is the mount for the slip-ring assembly for electrical power/communications and it is the drive shaft that 'transmits' the force from the above gear to the gun assembly.

The rotational indicator is also mounted to the circuit board. In a preferred embodiment of the invention, as shown in FIG. 19, the rotational indicator is a Hall Effect sensor 62, 86. A magnetic field extends through the space near the rear disc 61 that the sensors pass through. In a preferred embodiment of the invention, the electronics package includes a series of permanent magnets 65 located peripherally around the rear disc and attached to the rear bearing ring 66. As the gun rotates, the sensors detect the magnetic fields, thereby forming the rotational indicator. In a preferred embodiment of the invention, the rotational indicator is in communication with the electronic components mounted to the circuit board as will be discussed in greater detail below. ("Sensors and Transducers, Second Edition", Ronald K. Jurgen, 2003)

Figure 20:
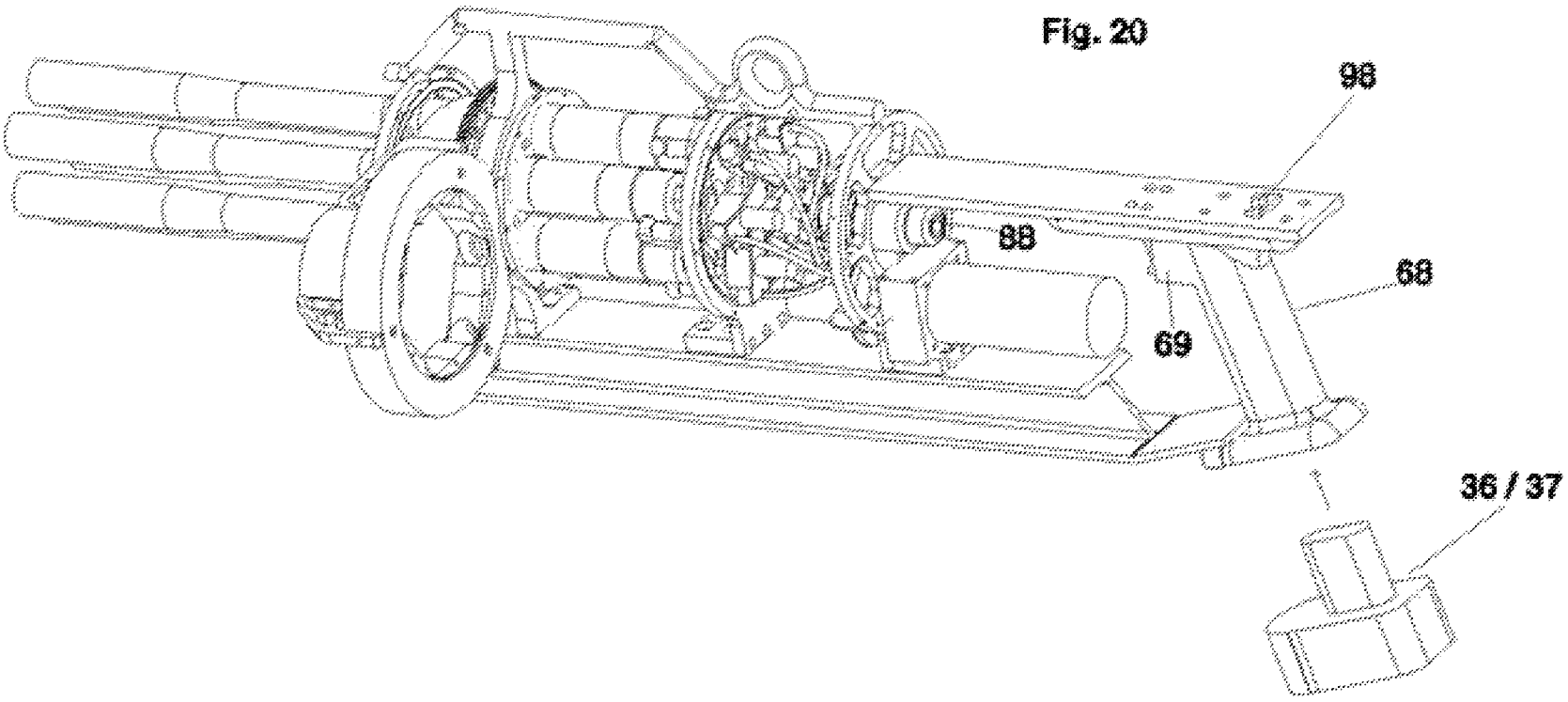
FIG. 20 is a side perspective view of the gatling gun mounted on a frame, the loader subassembly mounted in juxtaposition to the gun subassembly.

In addition to the components already described, the drive mechanism further includes a power supply 36, 37, as shown in FIG. 20. The power supply is mounted within the handgrip 68 and provides power for both the motor and the electronic components on the circuit board. In the preferred embodiment of the invention, the power supply is a rechargeable battery pack 37. This could also be remotely connected to the gun thru an electrical extension cable.

The housing is attached to the paintball gun(s) next to both the firing chamber and the barrels by the threaded connector and the support structure 82.

Figure 23:
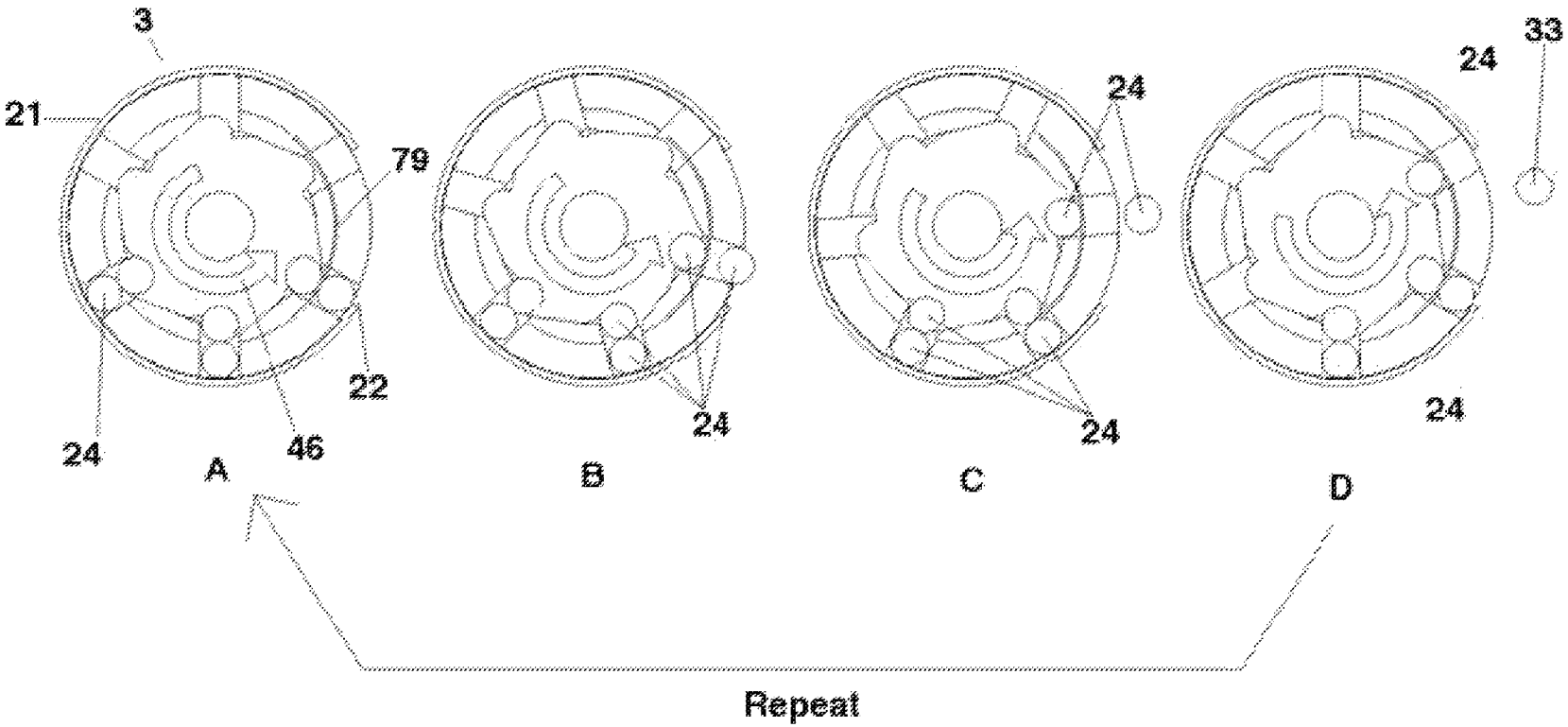
FIG. 23 is a rear view of a section of the loader which illustrates a cycle of paintball transfer from the loader to the gun subassembly, the cycle comprising holding, transfer, and delivery stages.

Since the loader body is rotatable within the loader housing, the loader body begins to rotate in the counter-clockwise direction as shown by arrow 46 in FIG. 23. As the loader body rotates, paintballs are moved from the interior of the hopper bin to the central cavity of the loader body. When the rotational speed of the loader is sufficient, centrifugal force contributes to urge paintballs generally into contact with the inner wall of the central cavity and subsequently into an inner port 16. As the loader body continues to rotate in the counter-clockwise direction, each of the individual paintballs contacts another paintball or a surface of the loader.

A distal end of the deflector occupies a small channel 75 that runs along the circumference of the loader body's outer surface. The channel is slightly wider than the distal end of the deflector and is approximately as deep as the diameter of a single paintball. The deflector includes a ramp that forms its distal end that contacts each of the paintballs to divert or assist the paintballs into a loading path as the paintball traverses the space between the outer port of a loader tube and the breech opening. Additionally, the deflector extends inwardly from the outer port a distance approximately equal to one paintball diameter. In this manner, the deflector acts to divert the individual paintballs from the tubes into the breech openings.

As the loader body continues to rotate, a continuous supply of paintballs is fed into the central cavity from the hopper bin. As can be understood in FIG. 4, the paintballs in the central cavity are forced into the loaders inner ports, travel centrifugally to the outer port, across the gap between the outer port and breech opening of a breech that is rotating as a member of a ring of barrels. It should be understood that a paintball is released from an outer port when the outer port radially traverses the open section of the retainer wall. Thus, each paintball of a continuous string of paintballs is force-pushed into a firing chamber, each firing chamber successively matched in rotation with a respective outer port rotating at a matching speed.

Once a paintball exits a loader tube, the paintballs begin to shift in the loader, until the paintballs are positioned in a stack inside the loader tube.

As the gun assembly rotates, multiple sensors 86 detect magnetic fields. When, this occurs, the microcontroller on the circuit board receives position and speed data. When the motor is turned on, the motor rotates the drive shaft to achieve the desired speed. While the motor runs, the control circuit monitors the speed of the motor and adjusts the motor voltage to maintain the desired speed. By using the rotational indicators, the control circuitry keeps the drive mechanism operating such that the drive mechanism achieves in cooperation with the loading and gun subassemblies supplies the required number of paintballs per second to be fired.

When a paintball is force pushed into a breech opening, the bolt then moves forward, as shown in FIG. 22 to push a single paintball further into the breech opening to a launching position from which the paintball can be propelled down the barrel.

The Loading Principle of the Loader

In a preferred embodiment of the present invention, the loader is a cylindrical-shaped transfer device subassembly, which rotates about a central shaft. Around the inner circumference of the wall of the rotary transfer device are a number of tubes positioned in the wall, each tube can respectively receive or stack two paintballs As the rotary transfer device rotates, it transports the paintball from the outer port to a launch position within the breech opening from where the paintball can be propelled from the gun.

A paintball transfer pathway is formed when the loader outer port and the breech opening are aligned.

When a loader tube outer port aligns with the breech opening, a paintball passes from the loader into the breech of a barrel. The rotary transfer loader device of the present invention urges paintballs out of the feed aperture and positions the paintball within the breech for subsequent launching.

Figure 5:
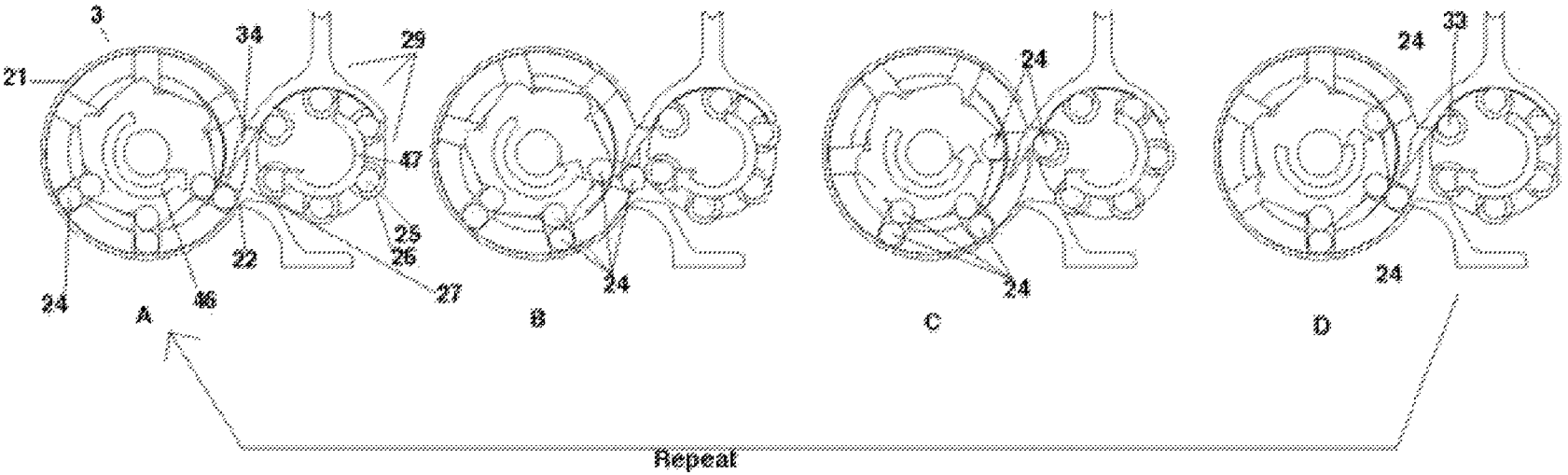
FIG. 5 is a partially disassembled rear view of paintball (projectile) transfer during operation.
Figure 6:
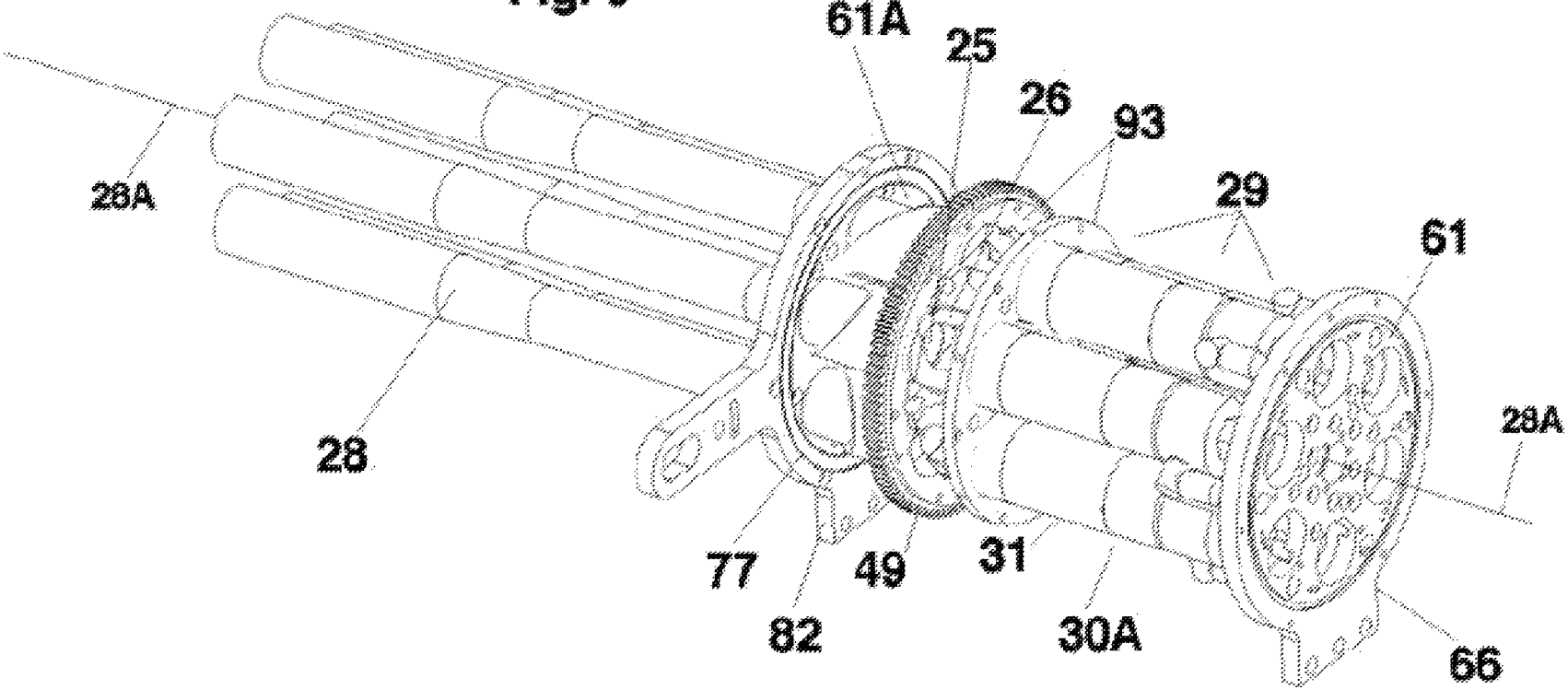
FIG. 6 is a perspective view of the rotatable assembly isolated from the loader.
Figure 7:
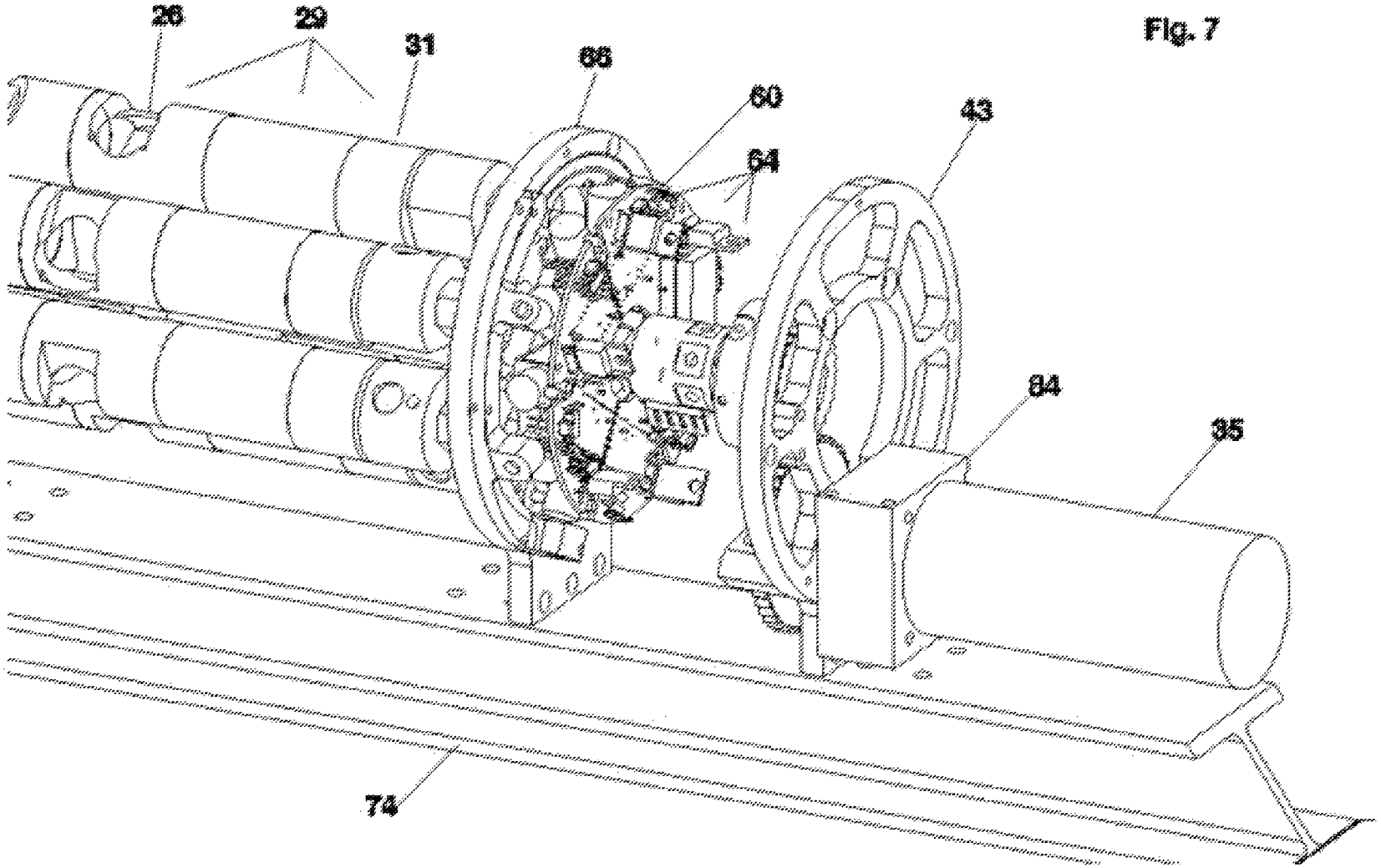
FIG. 7 is a view showing the mounting of the electronics and motor of the paintball gun.

Although there are six loader tubes shown in FIGS. 4 and 5, one skilled in the art would appreciate that the scope of the embodiments of the present invention is not limited to six loading tube for six guns. The present invention could be easily implemented with more or less tubes and/or guns as desired.

The loader of the invention may be driven by a number of different mechanisms. Preferably, electrical power is used to rotate the loader, but electromagnetic, magnetic pneumatic or even spring power could be used instead. As the gun assembly rotates about its axis by means of drive motor, push bolts are electro-pneumatically actuated, thereby moving forward and backward with each rotation of the gun assembly. As push bolts move forwardly, their forward surfaces engage the rear surfaces of the paintballs, and push paintball forwardly as indicated by arrows. Each paintball is driven forwardly from a breech and into the receiving end of the barrel of the Gatling gun.

Sensors

Figure 9:
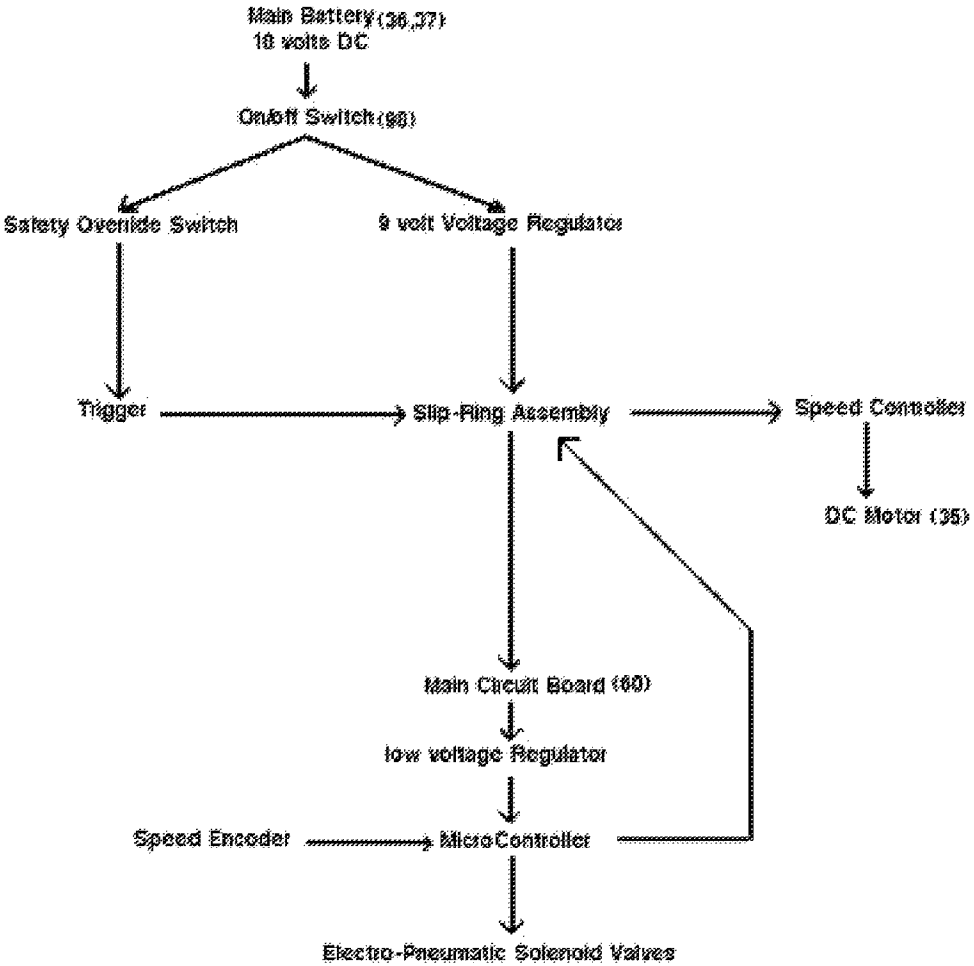
FIG. 9 is an electrical schematic of the paintball gun.

An embodiment of the present invention comprises a first sensor strategically positioned within the loader body in order to detect whether a projectile is present within one or more of the loader tubes. Preferably, the sensor is an optoelectronic device, but other kinds of sensors such as of the ultrasonic, inductive, or pressure type could be used equally well. A second sensor may also be positioned in the loader housing in order to detect the rotational position of the loader tube. Preferably, this sensor is an optoelectronic component as well, but an inductive or resistive sensor device could also be used with equal effectiveness. Signals from the sensors are passed by means of wires to a controller, which determines when to rotate the loader and at what speed. The controller operates the drive, which rotates the loader. Preferably, the controller is an electrical device, but it could also be implemented pneumatically. Once the power supply is connected, a control circuit, as shown in FIGS. 8 and 9 begins to monitor and operate the motor, sensors, pneumatic valves and various other components of the electro-mechanical system.

Further, an LED or LCD display may be provided in conjunction with the controller to monitor the operation of the loader. Optional control elements that interface with the controller may include buttons or levers to modify settings, an interface so that the system can be monitored by a remote device. Finally, the interface may be through a wired connection or other wireless means that allow both monitoring and control of the gun as well as allowing control programs as desired to be downloaded into the gun.

Figure 26:
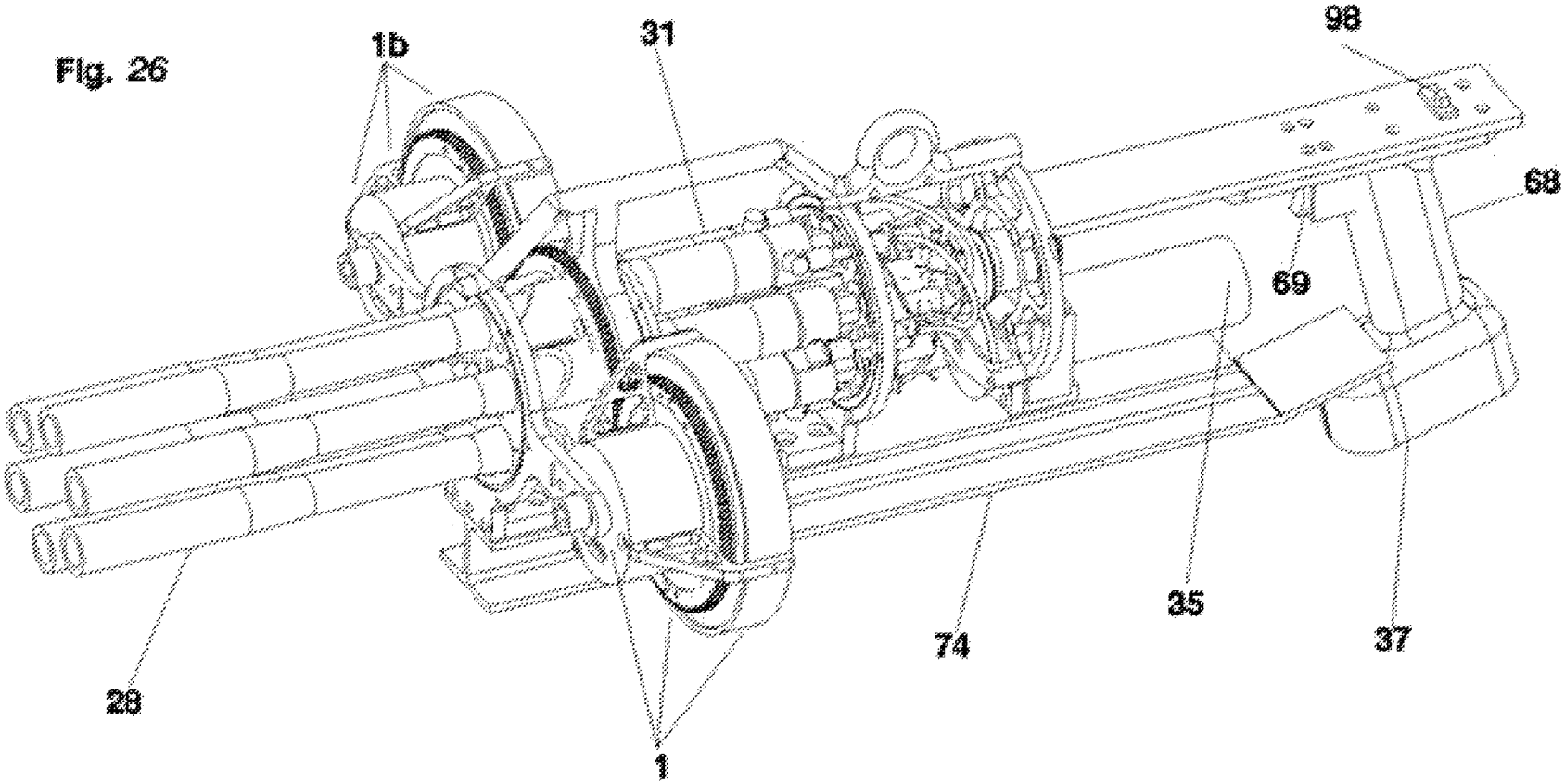
FIG. 26 is an embodiment of the gatling gun which comprises two loaders.

A further embodiment of the invention is directed to the gatling gun which comprises two loaders (FIG. 26).

What is claimed is:

1. A projectile launcher, comprising:

a) a rotatable gun assembly of pressurized-gas driven guns, wherein each gun comprises a breech opening, said gun assembly comprising a mounting arm;

b) a rotatable loader assembly mounted on said mounting arm and having an interior volume sufficient for storing a plurality of projectiles, said volume bounded by a wall having an inner surface and an outer surface;

c) at least one radially oriented loader tube formed in said wall and extending therethrough between an inner port and an outer port;

d) a set of timing gears linked between said loader assembly and said gun assembly, said gears aligning the outer ports and breech openings when said assemblies are in linked rotation;

e) a gap transfer space sufficiently large for transfer therethrough of a projectile from an outer port to a cognate breech opening;

f) a motor with a shaft operatively linked to said set of timing gears; and g) a source of pressurized-gas operatively connected to said guns;

whereby activation of said motor rotates the loader, urging projectiles through said loader tubes and through transfer gaps into the breeches of said rotating gun assembly for launching from said pressured gas-driven guns.

2. The projectile launcher of claim 1 wherein said projectiles are selected from the group consisting of paintballs, water balls, pepper balls, and solid rubber balls.

3. The projectile launcher of claim 1 wherein said projectile is a paintball.

4. The projectile launcher of claim 1 further comprising a trigger for activating and deactivating said motor.

5. The projectile launcher of claim 1 further comprising a power source.

6. The projectile launcher of claim 5 wherein said power source is electrical or compressed gas.

7. The projectile launcher of claim 1 further comprising a circuit for controlling the firing rate.

8. The projectile launcher of claim 1 further comprising a first sensor configured and arranged to detect the presence of a projectile within the breech.

9. The projectile launcher of claim 1 further comprising a second sensor configured and arranged to detect the rotational position of the rotatable loader assembly.

10. The projectile launcher of claim 1 further comprising a control unit connected to said first sensor and said shaft to control the timing and speed of rotation of the rotatable loader assembly.

11. The assembly of claim 8, further comprising a control unit connected to said second sensor and said shaft to control the timing and speed of rotation of the rotatable loader assembly.

12. A projectile launcher, comprising a) a rotatable gun assembly of pressurized-gas driven guns aligned in a guide, said gun assembly mounted on a frame, wherein each gun comprises a breech opening, said frame comprising a mounting arm;

b) a rotatable loader assembly mounted on said mounting arm and having an interior volume sufficient for storing a plurality of projectiles, said volume bounded by a wall having an inner surface and an outer surface;

c) at least one radially oriented loader tube formed in said wall and extending therethrough between an inner port and an outer port;

d) a set of timing gears linked between said loader assembly and said gun assembly, said gears aligning the outer ports and breech openings when said assemblies are in linked rotation;

e) a gap transfer space sufficiently large for transfer therethrough of a projectile from an outer port to a breech opening, said gap transfer space formed by cognate alignment of an outer port and a breech opening during rotation of said loader assembly and said gun assembly;

f) a motor with a shaft operatively linked to said set of timing gears;

g) a power source;

h) a circuit for controlling the firing rate;

i) a first sensor configured and arranged to detect the presence of a projectile within the breech;

j) a second sensor configured and arranged to detect the rotational position of the rotatable loader assembly;

k) a control unit connected to said first sensor and said shaft to control the timing and speed of rotation of the rotatable loader assembly;

l) a trigger for activating and deactivating said motor; and m) a source of pressurized-gas operatively connected to said guns, whereby activation of said motor rotates the loader, urging projectiles through said loader tubes and through transfer gaps into the breeches of said rotating gun assembly for launching from said pressured gas-driven guns.

13. The projectile launcher of claim 12 wherein said power source is electrical or compressed gas.

14. A rotatable loader assembly for urging projectiles into cognate breeches of a linked rotating gun assembly, said loader comprising a) an interior volume, said volume for storing a plurality of projectiles, said volume bounded by a wall having an inner surface and an outer surface;

b) at least one radially oriented loader tube formed in said wall and extending therethrough between an inner port and an outer port, said loader tubes for conveying a projectile from said interior volume to a cognate breech;

c) a timing gear for operative linkage with a timing gear of a rotatable gun assembly for rotation of said loader assembly upon rotation of said gun assembly;

wherein said loader assembly rotates about a longitudinal axis in parallel with the longitudinal axis of cognate breech to align an outer port to a cognate breech opening of a gun of said rotatable gun assembly.

15. The rotatable loader assembly of claim 14 further comprising a sensor configured and arranged to detect the presence of a projectile within a loader tube.

16. The rotatable loader of claim 15 further comprising a second sensor configured and arranged to detect the rotational position of the rotatable loader assembly.

17. The rotatable loader of claim 16 further comprising: a control unit connected to said first sensor and drive of said gun assembly to control the timing and speed of rotation of the rotatable loader assembly.

18. The rotatable loader of claim 17 further comprising a control unit connected to said second sensor and said drive to control the timing and speed of rotation of the rotatable loader assembly.

19. The rotatable loader of claim 15 in combination with a rotating gun assembly.

20. A method of ejecting a projectile from a multi-barreled rotating gun assembly, comprising the steps of:

a) providing projectiles from a rotating housing which comprises an interior volume to loader tubes formed in the wall of said housing;

b) rotating loaders tube of a rotatable loader assembly at a rotational speed approximately equal to the rotational speed of cognate breeches of said rotating gun assembly;

c) releasing projectiles from said rotating loader tubes into rotating cognate breeches d) supplying an amount of gas to the barrel comprising said cognate breech at a pressure causing the projectile to be ejected from the barrel.

* * * * *